US009868601B2

(12) United States Patent
Fujii et al.

(10) Patent No.: US 9,868,601 B2
(45) Date of Patent: Jan. 16, 2018

(54) SHEET FEEDER AND IMAGE FORMING APPARATUS INCORPORATING THE SHEET FEEDER

(71) Applicants: Ikuo Fujii, Osaka (JP); Ippei Kimura, Osaka (JP); Mizuna Tanaka, Osaka (JP); Hirofumi Horita, Osaka (JP); Tomoya Tanaka, Osaka (JP)

(72) Inventors: Ikuo Fujii, Osaka (JP); Ippei Kimura, Osaka (JP); Mizuna Tanaka, Osaka (JP); Hirofumi Horita, Osaka (JP); Tomoya Tanaka, Osaka (JP)

(73) Assignee: RICOH COMPANY, LTD., Tokyo (JP)

( * ) Notice: Subject to any disclaimer, the term of this patent is extended or adjusted under 35 U.S.C. 154(b) by 54 days.

(21) Appl. No.: 14/670,898

(22) Filed: Mar. 27, 2015

(65) Prior Publication Data

US 2015/0274450 A1 Oct. 1, 2015

(30) Foreign Application Priority Data

Apr. 1, 2014 (JP) ..... 2014-075428

(51) Int. Cl.
*B65H 3/52* (2006.01)
*B65H 3/06* (2006.01)
(Continued)

(52) U.S. Cl.
CPC ..... *B65H 3/5223* (2013.01); *B65H 3/06* (2013.01); *B65H 3/56* (2013.01); *B65H 3/68* (2013.01);
(Continued)

(58) Field of Classification Search
CPC ... B65H 3/06; B65H 3/46; B65H 3/52; B65H 3/5207; B65H 3/5215; B65H 3/5223;
(Continued)

(56) References Cited

U.S. PATENT DOCUMENTS 6,485,014 B1 * 11/2002 Lin ..... B65H 3/5223 221/167
9,487,364 B2 * 11/2016 Kimura ..... B65H 3/5223
(Continued)

FOREIGN PATENT DOCUMENTS

JP 8-002721 1/1996
JP 2005-154052 6/2005
(Continued)

OTHER PUBLICATIONS

U.S. Appl. No. 14/641,944, filed Mar. 9, 2015.
U.S. Appl. No. 14/669,615, filed Mar. 26, 2015.

*Primary Examiner* — Prasad V Gokhale
(74) *Attorney, Agent, or Firm* — Harness, Dickey & Pierce

(57) ABSTRACT

A sheet feeder, which can be included in an image forming apparatus, includes a rotary body to contact and feed a recording medium to a downstream side along a sheet conveying path, a friction body disposed facing and contacting the rotary body with the sheet conveying path interposed therebetween, the friction body forming a separation nip region with the rotary body, a receiver to support the friction body at a position opposite to the separation nip region, and multiple projections to guide the recording medium toward the separation nip region. Each of the multiple projections extends toward the rotary body at respective axial ends of the rotary body and has a top face disposed upstream from the separation nip region in a sheet conveying direction between an outer circumferential surface of the rotary body and a surface of the friction body.

19 Claims, 21 Drawing Sheets

(51) Int. Cl.
*B65H 3/68* (2006.01)
*B65H 3/56* (2006.01)

(52) U.S. Cl.
CPC ..... *B65H 2404/5213* (2013.01); *B65H 2404/5214* (2013.01)

(58) Field of Classification Search
CPC .. B65H 3/5246; B65H 3/5253; B65H 3/5261; B65H 3/5269; B65H 2405/113; B65H 2405/1132; B65H 2405/1136; B65H 2405/1138; B65H 3/68; B65H 2404/5213; B65H 2404/5214; B65H 3/56
See application file for complete search history.

(56) References Cited

U.S. PATENT DOCUMENTS

| | | | | |
|---|---|---|---|---|
| 9,511,962 | B2 * | 12/2016 | Tanaka | B65H 3/06 |
| 2004/0065993 | A1 * | 4/2004 | Kamijoh | B65H 3/06 271/121 |
| 2006/0113721 | A1 * | 6/2006 | Kim | B65H 3/06 271/121 |
| 2009/0121418 | A1 * | 5/2009 | Tanaka | B65H 3/5223 271/226 |
| 2009/0174135 | A1 | 7/2009 | Tanaka et al. | |
| 2009/0315250 | A1 | 12/2009 | Kimura et al. | |
| 2010/0059930 | A1 | 3/2010 | Tanaka et al. | |
| 2012/0104690 | A1 * | 5/2012 | Tanaka | B65H 3/06 271/258.01 |
| 2013/0142561 | A1 * | 6/2013 | Kim | B65H 3/0607 400/642 |
| 2013/0228963 | A1 * | 9/2013 | Taniguchi | B65H 3/06 271/109 |
| 2014/0049000 | A1 * | 2/2014 | Kimura | B65H 3/5223 271/3.14 |
| 2015/0274452 | A1 * | 10/2015 | Tanaka | B65H 3/06 271/10.16 |

FOREIGN PATENT DOCUMENTS

| | | | | |
|---|---|---|---|---|
| JP | 2005-343582 | | 12/2005 | |
| JP | 2009001366 | A * | 1/2009 | B65H 3/0607 |
| JP | 2009001366 | A * | 1/2009 | B65H 3/0607 |
| JP | 2009-067570 | | 4/2009 | |
| JP | 2009-091136 | | 4/2009 | |
| JP | 2009-161301 | | 7/2009 | |
| JP | 2009-203071 | | 9/2009 | |
| JP | 2010-001122 | | 1/2010 | |
| JP | 2010-018413 | | 1/2010 | |
| JP | 2010-058962 | | 3/2010 | |
| JP | 2010-064804 | | 3/2010 | |
| JP | 2010-070281 | | 4/2010 | |
| JP | 2010-235313 | | 10/2010 | |
| JP | 2011-057372 | | 3/2011 | |
| JP | 2012-096880 | | 5/2012 | |
| JP | 2013-049531 | | 3/2013 | |
| JP | 2014-019502 | | 2/2014 | |
| JP | 2014-037299 | | 2/2014 | |
| JP | 2014-169168 | | 9/2014 | |
| JP | 2015-016932 | | 1/2015 | |
| JP | 2015-020840 | | 2/2015 | |
| JP | 2015124058 | A * | 7/2015 | B65H 3/42 |
| JP | 2015124058 | A * | 7/2015 | B65H 3/42 |

* cited by examiner

| No. | A | B | TEST RESULTS | | REF |
|---|---|---|---|---|---|
| | | | MULTI-FEED | LE FOLD MISFEED | |
| 1 | LARGE | NO | ○ | × | COMPARATIVE EXAMPLE |
| 2 | SMALL | NO | × | ○ | |
| 3 | LARGE | BELOW PAD | × | ○ | |
| 4 | | ABOVE PAD AND BELOW SHEET FEED ROLLER (BETWEEN PAD AND SHEET FEED ROLLER) | ○ | ○ | THIS EXAMPLE |
| 5 | | ABOVE SHEET FEED ROLLER | × | × | |

○ : GOOD
× : POOR

SHEET FEEDER AND IMAGE FORMING APPARATUS INCORPORATING THE SHEET FEEDER

CROSS-REFERENCE TO RELATED APPLICATIONS

This patent application is based on and claims priority pursuant to 35 U.S.C. §119(a) to Japanese Patent Application No. 2014-075428, filed on Apr. 1, 2014, in the Japan Patent Office, the entire disclosure of which is hereby incorporated by reference herein.

BACKGROUND

Technical Field

This disclosure relates to a sheet feeder that is attached to a copier, facsimile machine, printer, printing machine, and a multi-functional apparatus including at least two functions of the copier, facsimile machine, printer, and printing machine to separate and feed a sheet-like recording medium, and an image feeding apparatus and an image reading device incorporating the sheet feeder.

Related Art

Sheet conveyance (conveyability of sheets) is one of qualities of an image forming apparatus such as a copier, facsimile machine, printer and the like. In recent years, various types of sheets are used in an image forming apparatus, and therefore it is indispensable to enhance quality of feed and separation of sheets. RF (roller friction) feeding system and FRR (feed and reverse roller) feeding system are known as a sheet feeder that perform high quality feed and separation of sheets.

Indeed, the RF feeding system and the FRR feeding system can provide a high quality performance in feed and separation of sheets. However, these systems cannot reduce both costs and size of the image forming apparatus.

By contrast, a separation pad feeding system (also known as a friction pad feeding system) is known as a relatively reasonable and compact sheet feeder.

The separation pad feeding system includes a receiver having a friction member, i.e., a separation pad below a sheet feed roller. The separation pad feeding system causes a sheet fed by the sheet feed roller to contact the separation pad, so that multifeed of sheets is prevented due to friction between the separation pad and the sheet. According to this action, a single sheet contacting the sheet feed roller, which is an uppermost sheet, is separated from the other sheets in a sheet container and fed toward an image forming part.

The separation pad is formed by a material having a friction coefficient smaller than that of the sheet feed roller. For example, the separation pad is formed from a single member made of natural rubber, cork, leather, urethane rubber, synthetic rubber or the like.

SUMMARY

At least one aspect of this disclosure provides a sheet feeder including a rotary body to contact and feed a recording medium to a downstream side along a sheet conveying path, a friction body disposed facing and contacting the rotary body with the sheet conveying path interposed therebetween, the friction body forming a separation nip region with the rotary body, a receiver to support the friction body at a position opposite to the separation nip region, and multiple projections forming a pair of projections to guide the recording medium toward the separation nip region.

Each of the multiple projections extends toward the rotary body at respective axial ends of the rotary body and has a top face disposed upstream from the separation nip region in a sheet conveying direction between an outer circumferential surface of the rotary body and a surface of the friction body.

Further, at least one aspect of this disclosure provides an image forming apparatus including the above-identified sheet feeder.

DETAILED DESCRIPTION

Figure 1:
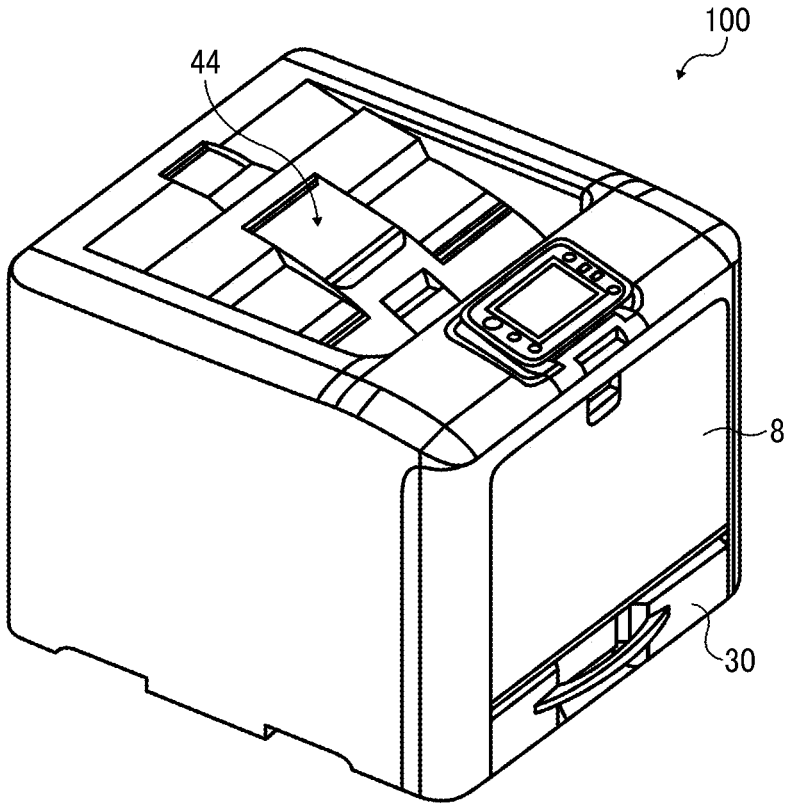
FIG. 1 is a perspective view illustrating an external appearance of an image forming apparatus according to an example of this disclosure.

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used to distinguish one element, component, region, layer or section from another region, layer or section. Thus, a first element, component, region, layer or section discussed below could be termed a second element, component, region, layer or section without departing from the teachings of the present disclosure.

The terminology used herein is for describing particular embodiments and examples and is not intended to be limiting of exemplary embodiments of this disclosure. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Descriptions are given, with reference to the accompanying drawings, of examples, exemplary embodiments, modification of exemplary embodiments, etc., of an image forming apparatus according to exemplary embodiments of this disclosure. Elements having the same functions and shapes are denoted by the same reference numerals throughout the specification and redundant descriptions are omitted. Elements that do not demand descriptions may be omitted from the drawings as a matter of convenience. Reference numerals of elements extracted from the patent publications are in parentheses so as to be distinguished from those of exemplary embodiments of this disclosure.

This disclosure is applicable to any image forming apparatus, and is implemented in the most effective manner in an electrophotographic image forming apparatus.

In describing preferred embodiments illustrated in the drawings, specific terminology is employed for the sake of clarity. However, the disclosure of this disclosure is not intended to be limited to the specific terminology so selected and it is to be understood that each specific element includes any and all technical equivalents that have the same function, operate in a similar manner, and achieve a similar result.

Referring now to the drawings, wherein like reference numerals designate identical or corresponding parts throughout the several views, preferred embodiments of this disclosure are described.

Descriptions are given of an example applicable to a sheet feeder and an image forming apparatus incorporating the sheet feeder with reference to the following figures. It is to be noted that identical parts are given identical reference numerals and redundant descriptions are summarized or omitted accordingly.

It is to be noted in the following examples that: the term "image forming apparatus" indicates an apparatus in which an image is formed on a recording medium such as paper, OHP (overhead projector) transparencies, OHP film sheets, thread, fiber, fabric, leather, metal, plastic, glass, wood, and/or ceramic by attracting developer or ink thereto; the term "image formation" indicates an action for providing (i.e., printing) not only an image having meanings such as texts and figures on a recording medium but also an image having no meaning such as patterns on a recording medium; and the term "sheet" is not limited to indicate a paper material but also includes the above-described plastic material (e.g., a OHP sheet), a fabric sheet and so forth, and is used to which the developer or ink is attracted. In addition, the "sheet" is not limited to a flexible sheet but is applicable to a rigid plate-shaped sheet and a relatively thick sheet.

Further, size (dimension), material, shape, and relative positions used to describe each of the components and units are examples, and the scope of this disclosure is not limited thereto unless otherwise specified.

Configuration of Image Forming Apparatus.

A sheet feeder 600 according to this disclosure is applicable to be employed to an image forming apparatus 100 or an image reading device.

Figure 2:
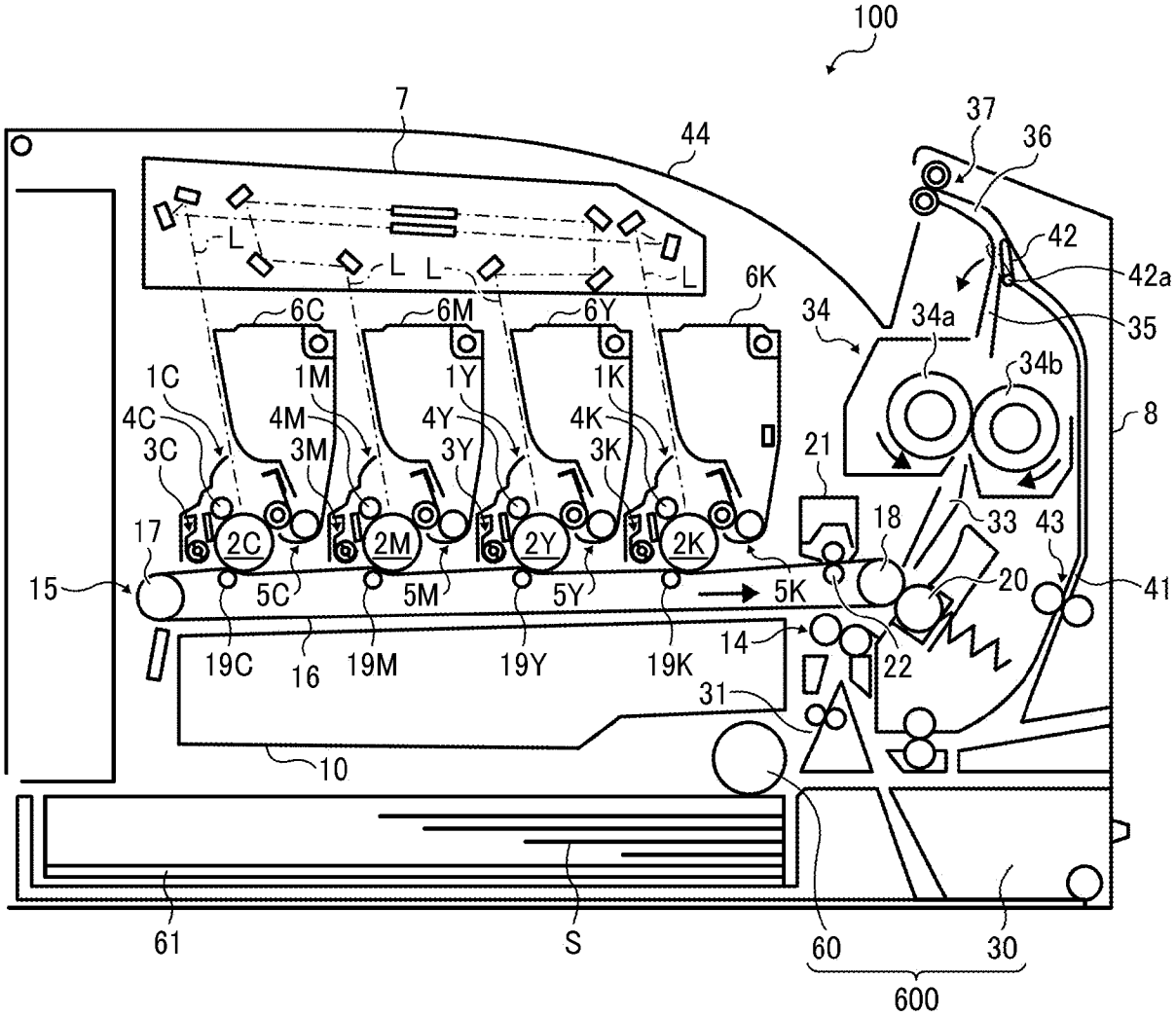
FIG. 2 is a vertical sectional view illustrating a schematic configuration of the image forming apparatus of FIG. 1.

FIG. 1 illustrates an external appearance of the image forming apparatus 100 according to an example of this disclosure. FIG. 2 illustrates a schematic configuration of the image forming apparatus 100 of FIG. 1.

The image forming apparatus 100 may be a copier, a printer, a scanner, a facsimile machine, a plotter, and a multifunction peripheral or a multifunction printer (MFP)

having at least one of copying, printing, scanning, facsimile, and plotter functions, or the like. According to the present example, the image forming apparatus 100 is an electrophotographic printer that forms toner images on a sheet or sheets by electrophotography.

Further, this disclosure is also applicable to image forming apparatuses adapted to form images through other schemes, such as known ink jet schemes, known toner projection schemes, or the like as well as to image forming apparatuses adapted to form images through electro-photographic schemes.

As illustrated in FIG. 2, the image forming apparatus 100 includes four process units 1K, 1Y, 1M, and 1C.

Suffixes, which are K, Y, M, and C, are used to indicate respective colors of toners (e.g., black, yellow, magenta, and cyan toners) for the process units. The process units 1K, 1Y, 1M, and 1C have substantially the same configuration except for containing different color toners of black (K), yellow (Y), magenta (M), and cyan (C) corresponding to color separation components of a color image.

The process units 1K, 1Y, 1M, and 1C have the same structure, differing only in the colors of toners in the toner bottles 6K, 6Y, 6M, and 6C. Therefore, these components and units having an identical configuration but a different color are hereinafter referred to in a singular form without suffixes occasionally, for example, as the process unit 1.

The process units 1K, 1Y, 1M, and 1C further include photoconductor drums 2K, 2Y, 2M, and 2C functioning as image bearers, drum cleaning units 3K, 3Y, 3M, and 3C, electricity discharging units, charging units 4K, 4Y, 4M, and 4C functioning as chargers, and developing units 5K, 5Y, 5M, and 5C, respectively. The process units 1K, 1Y, 1M, and 1C are detachably attachable to an apparatus body of the image forming apparatus 100, and consumable parts can be replaced at one time.

The image forming apparatus 100 further includes an optical writing device 7 disposed above the process units 1K, 1Y, 1M, and 1C.

A transfer device 15 is disposed below the process units 1Y, 1C, 1M, and 1K in this configuration. The transfer device 15 includes four primary transfer rollers 19K, 19Y, 19M, and 19C, an intermediate transfer belt 16, a secondary transfer roller 20, a belt cleaning unit 21, and a cleaning backup roller. The primary transfer rollers 19K, 19Y, 19M, and 19C are disposed facing the photoconductor drums 2K, 2Y, 2M, and 2C, respectively.

An intermediate transfer belt 16 is an endless belt that is entrained around the primary transfer rollers 19K, 19Y, 19M, and 19C, a driving roller 18, and a driven roller 17.

A secondary transfer roller 20 that functions as a secondary transfer unit is disposed facing the driving roller 18 to form a secondary transfer nip region therebetween.

The photoconductor drums 2K, 2Y, 2M, and 2C are defined as first image bearers, and the intermediate transfer belt 16 may be a second image bearer that carries a composite image thereon.

A belt cleaning unit 21 is disposed downstream from the secondary transfer roller 20 in a direction of rotation of the intermediate transfer belt 16. A cleaning backup roller 22 is disposed opposite to the belt cleaning unit 21 with the intermediate transfer belt 16 sandwiched therebetween.

The image forming apparatus 100 further includes a sheet tray 30 that is disposed at a lower part of the image forming apparatus 100. The sheet tray 30 is detachably attachable to the apparatus body of the image forming apparatus 100 for sheet supply, for example. A sheet feed roller 60 that functions as a sheet feeding body is disposed above the sheet tray 30 in a state in which the sheet tray 30 is set in the apparatus body of the image forming apparatus 100, as illustrated in FIG. 2. A sheet S is fed from the sheet tray 30 toward a sheet feeding path 31. The sheet tray 30 and the sheet feed roller 60 form the sheet feeder 600.

A timing roller pair 14 is disposed immediately upstream from the secondary transfer roller 20 to stop the sheet S fed from the sheet tray 30 thereat temporarily. By stopping the sheet S temporarily at the timing roller pair 14, the sheet S is sagged at the leading end thereof.

The sagged sheet S is further sent to the secondary transfer nip region between the secondary transfer roller 20 and the driving roller 18 so as to synchronize with a toner image formed on the intermediate transfer belt 16 at a given timing at which the toner image is transferred preferably. The toner image formed on the intermediate transfer belt 16 at the secondary transfer nip region is transferred onto the sheet S with high accuracy at a desired transfer position.

A post-transfer sheet conveying path 33 is disposed above the secondary transfer nip region formed between the secondary transfer roller 20 and the driving roller 18. A fixing device 34 is disposed in a vicinity of a leading end of the post-transfer sheet conveying path 33.

The fixing device 34 includes a fixing roller 34*a* and a pressure roller 34*b*. The fixing roller 34*a* includes a heat generating source such as a halogen lamp. The pressure roller 34*b* is pressed against the fixing roller 34*a*. The fixing roller 34*a* and the pressure roller 34*b* contacting each other form a fixing nip region.

A post-fixing sheet conveyance path 35 is disposed above the fixing device 34. The post-fixing sheet conveyance path 35 branches at the downstream end thereof at its highest position into two paths, which are a sheet discharging path 36 and a switchback conveyance path 41.

A switching member 42 is disposed at the downstream end of the post-fixing sheet conveyance path 35. The switching member 42 rotates about a swing shaft 42*a* for switching a conveyance direction of the sheet S.

A sheet discharging roller pair 37 is disposed at a downstream end of an opening of the sheet discharging path 36.

The switchback conveyance path 41 meets the sheet feeding path 31 at the downstream end of the post-fixing sheet conveyance path 35.

A switchback conveyance roller pair 43 is disposed in the middle of the switchback conveyance path 41.

A sheet discharging tray 44 is formed on top of the apparatus body of the image forming apparatus 100. The sheet discharging tray 44 includes a top cover recessed inwardly.

The powder container 10 (i.e., a toner container) is disposed between the transfer device 15 and the sheet tray 30 to contain waste toner therein. The powder container 10 is detachably attachable to the apparatus body of the image forming apparatus 100.

In the image forming apparatus 100 according to the present example, it is designed that the sheet feed roller 60 is separated from the secondary transfer roller 20 by a certain distance or gap due to conveyance of a sheet such as the sheet S. This separation generates dead space or unused space. By disposing the powder container 10 in the dead space, a reduction in overall size of the image forming apparatus 100 is achieved.

A transfer cover 8 is disposed above and in front of the sheet tray 30 in a sheet removing direction. By opening the transfer cover 8, an inside of the image forming apparatus 100 can be inspected. The transfer cover 8 is provided with a bypass tray from which the sheet S can be fed and a bypass feed roller by which the sheet S is fed from the bypass tray.

It is to be noted that, even though the image forming apparatus 100 according to this disclosure has a configuration of a printer, the configuration and functions of the image forming apparatus 100 are not limited to a printer. Specifically, the image forming apparatus 100 is applicable to any of a copier, facsimile machine, printer, printing machine, ink jet recording device, and a multi-functional apparatus including at least two functions of the copier, facsimile machine, printer, printing machine, and ink jet recording device.

Next, a description is given of basic image forming operations of the image forming apparatus 100 according to an example of this disclosure with reference to FIG. 2.

First, basic operations of a simplex or single-sided printing are described.

As illustrated in FIG. 2, a controller provided to the image forming apparatus 100 issues sheet feeding signals. In response to the sheet feeding signals, the controller causes the sheet feed roller 60 to rotate. As the sheet feed roller 60 starts to rotate, the sheet S placed on top of a bundle of sheets in the sheet tray 30 is separated from the other sheets accommodated in the sheet tray 30 to be fed toward the sheet feeding path 31.

When the leading edge of the sheet S reaches the secondary transfer nip region of the timing roller pair 14, the sheet S stands by while being sagged so that skew at the leading edge of the sheet S is calibrated and that movement of the sheet S is synchronized with movement of a toner image formed on the intermediate transfer belt 16.

When feeding the sheet S from the bypass tray, the sheet S placed on top of the bundle of sheets loaded on the bypass tray is fed one by one by the bypass feed roller. The sheet S fed from the bypass tray is fed by the bypass feed tray to travel part of the switchback conveyance path 41 to the secondary transfer nip region of the timing roller pair 14. The following operations using the bypass tray are the same operations in sheet feeding from the sheet tray 30, and therefore are omitted.

Here, the components and units having an identical configuration but a different color of the process units 1K, 1Y, 1M, and 1C are hereinafter referred to in a singular form without suffixes occasionally, for example, as the process unit 1.

In the basic image forming operations of the process unit 1, the charging unit 4 uniformly charges a surface of the photoconductor drum 2 by supplying a high electric potential at the surface of the photoconductor drum 2.

Based on image data, a laser light beam L is emitted from the optical writing device 7 to the charged surface of the photoconductor drum 2, so that the electric potential at the emitted portion on the surface of the photoconductor drum 2 decreases to form an electrostatic latent image.

The toner bottle 6 supplies the unused color toner to the developing unit 5. The developing unit 5 then supplies the respective color toner to the electrostatic latent image formed on the surface of the photoconductor drum 2 to develop the electrostatic latent image into a visible toner image. Then, the toner image formed on the surface of the photoconductor drum 2 is transferred onto a surface of the intermediate transfer belt 16.

The drum cleaning unit 3 removes residual toner remaining on the surface of the photoconductor drum 2 after an intermediate transfer operation. The removed residual toner is conveyed by a waste toner conveyance unit and collected to a waste toner collecting unit included in the process unit 1. The electricity discharging unit removes residual electric potential remaining on the surface of the photoconductor drum 2 after cleaning.

As previously described, the above description details operations are performed in each of the process units 1K, 1Y, 1M, and 1C. For example, respective toner images are developed on the respective surfaces of the photoconductor drums 2K, 2Y, 2M, and 2C and are then sequentially transferred onto the surface of the intermediate transfer belt 16 to form a composite color image.

After the respective color toner images are transferred sequentially onto the surface of the intermediate transfer belt 16 to form a composite toner image, the intermediate transfer belt 16 moves to the secondary transfer nip region formed between the secondary transfer roller 20 and the driving roller 18, where the toner image formed on the intermediate transfer belt 16 is transferred onto the sheet S conveyed by the timing roller pair 14.

Specifically, the sheet S is fed to the secondary transfer nip region at an optimal timing in synchronization with movement of the composite toner image formed by sequentially overlaying the respective color toner images and transferred onto the surface of the intermediate transfer belt 16. Then, the composite toner image formed on the surface of the intermediate transfer belt 16 is transferred onto the sheet S conveyed as above at a desired position in the secondary transfer nip region formed between the driving roller 18 and the secondary transfer roller 20 with the intermediate transfer belt 16 interposed therebetween with high accuracy.

The sheet S on which the transferred toner image is formed passes through the post-transfer sheet conveying path 33 to the fixing device 34. In the fixing device 34, the sheet S passes between the fixing roller 34*a* and the pressure roller 34*b*. Thus, the unfixed toner image on the sheet S is fixed to the sheet S by application of heat and pressure. The sheet S with the fixed image thereon is conveyed from the fixing device 34 to the post-fixing sheet conveyance path 35.

At the feeding of the sheet S from the fixing device 34, the switching member 42 is at a position as illustrated by a solid line in FIG. 2 to allow passage of the sheet S around an open space at the end of the post-fixing sheet conveyance path 35. After traveling from the fixing device 34 through the post-fixing sheet conveyance path 35, the sheet S is sandwiched by and passes through the sheet discharging roller pair 37, and is discharged to the sheet discharging path 36. As described above, the sheet discharging roller pair 37 sandwiches the sheet S fed to the sheet discharging path 36 and rotates to convey the sheet to the sheet discharging tray 44. By performing this operation, a series of the simplex printing operations is completed.

Next, basic operations of a duplex or double-sided printing are described.

Similar to the operations of a simplex printing, the sheet S having a fixed image on one side thereof is conveyed from the fixing device 34 to the sheet discharging path 36.

When performing duplex printing, the sheet discharging roller pair 37 rotates to convey the sheet S so that part of the sheet S is exposed to an outside of the image forming apparatus 100.

As the trailing end of the sheet S passes through the sheet discharging path 36, the switching member 42 rotates about the swing shaft 42*a* to a position indicated by a dotted line in FIG. 2 to block the passage of the sheet S at the end of the post-fixing sheet conveyance path 35. Substantially simultaneously, the sheet discharging roller pair 37 rotates in reverse to feed the sheet S in an opposite direction to the switchback conveyance path 41.

The sheet S conveyed in the switchback conveyance path 41 passes through the switchback conveyance roller pair 43 and reaches the timing roller pair 14. The timing roller pair 14 measures optimal timing to transfer a toner image formed on the intermediate transfer belt 16 onto an unprinted side, i.e., a reverse side of the sheet S in synchronization with the toner image formed on the surface of the intermediate transfer belt 16 and conveys the sheet S to the secondary transfer nip region.

When the sheet S passes through the secondary transfer nip region formed between the driving roller 18 and the secondary transfer roller 20 with the intermediate transfer belt 16 interposed therebetween, the toner image is transferred onto on the reverse side of the sheet S on which no image has not yet formed. The sheet S having the toner image formed on the reverse side thereof is then conveyed to the fixing device 34 via the post-transfer sheet conveying path 33.

In the fixing unit 34, the sheet S is sandwiched by the fixing roller 34*a* and the pressure roller 34*b* to fix the unfixed toner image formed on the unused reverse side of the sheet S to the sheet S by application of heat and pressure. The sheet S with the fixed toner image thereon is conveyed from the fixing device 34 to the post-fixing sheet conveyance path 35.

At the feeding of the sheet S from the fixing device 34, the switching member 42 is at the position as illustrated by a solid line in FIG. 2 to allow passage of the sheet S around an open space at the end of the post-fixing sheet conveyance path 35. After traveling from the fixing device 34, the sheet S is conveyed to the sheet discharging path 36 via the post-fixing sheet conveyance path 35. The sheet discharging roller pair 37 sandwiches the sheet S in the sheet discharging path 36 and rotates to convey the sheet S to discharge to the sheet discharging tray 44. By performing this operation, a series of the duplex printing operations is completed.

Even after the toner image formed on the surface of the intermediate transfer belt 16 is transferred onto the sheet S, residual toner remains on the surface of the intermediate transfer belt 16. The belt cleaning device 21 removes the residual toner from the intermediate transfer belt 16. After being removed from the intermediate transfer belt 16, the residual toner is conveyed by the waste toner conveyance unit and collected to the powder container 10.

Basic Configuration of Sheet Feeder Using Separation Pad Feeding System.

Figure 3A:
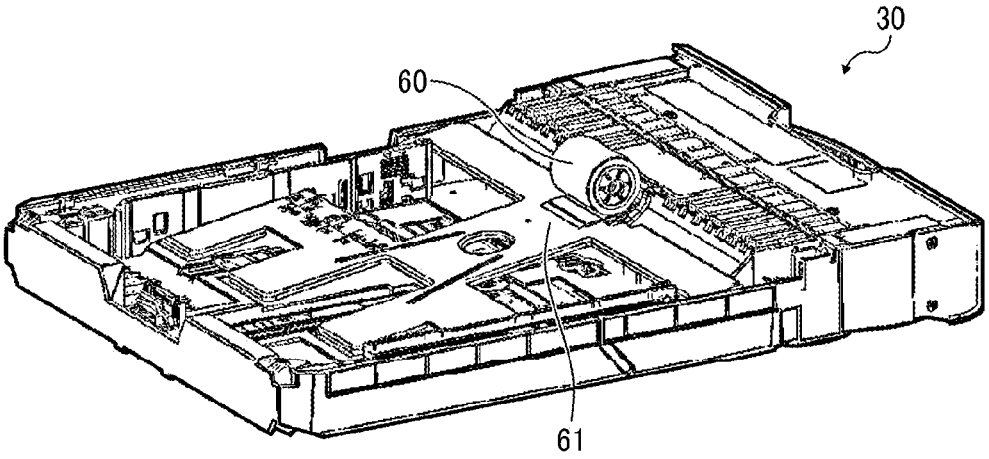
FIG. 3A is a perspective view illustrating a sheet tray included in the image forming apparatus of FIG. 1.
Figure 3B:
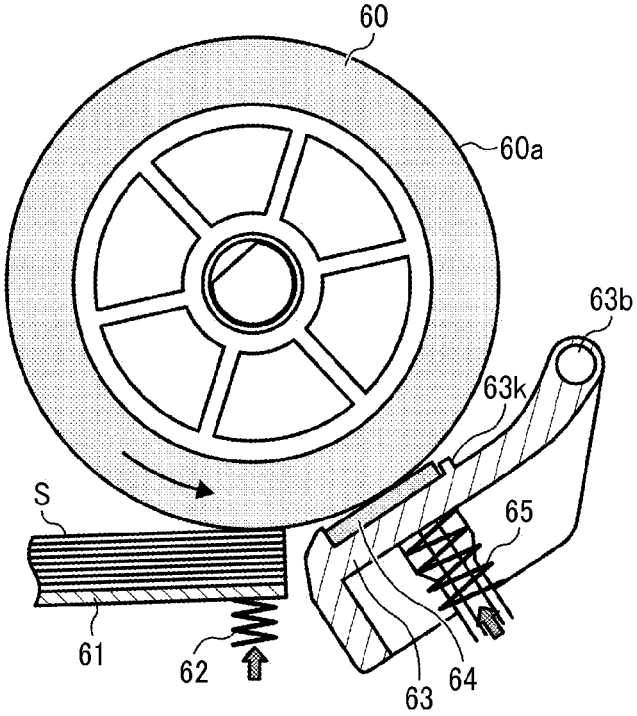
FIG. 3B is a cross sectional view illustrating a sheet feed roller and a separation pad having a general configuration.
Figure 3C:
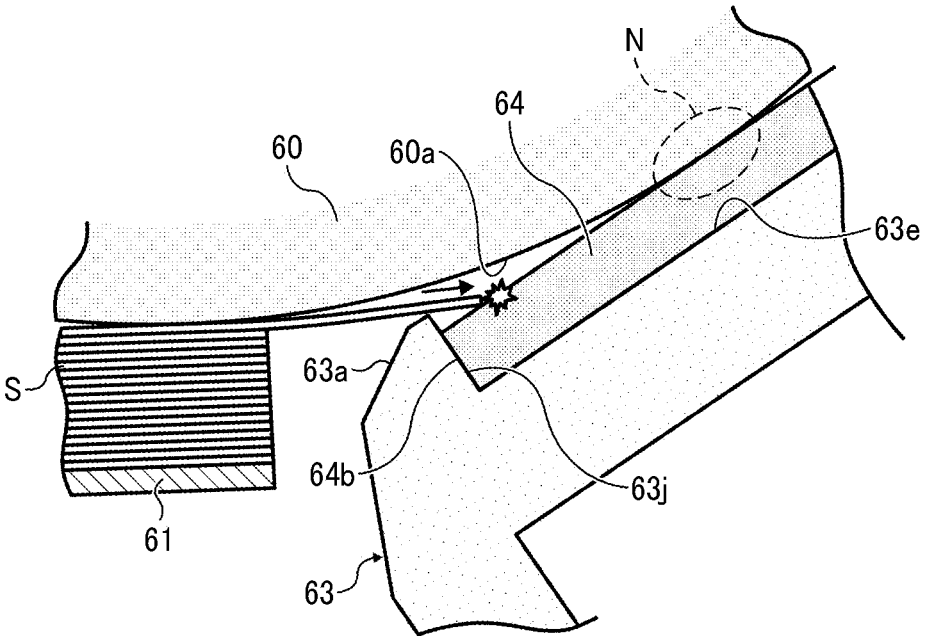
FIG. 3C is an enlarged side view illustrating the sheet feed roller and the separation pad of FIG. 3B.

FIG. 3A is a perspective view illustrating the sheet tray 30 included in the image forming apparatus 100 of FIG. 1, viewed from an obliquely upper direction of a rear side of the sheet tray 30 in a sheet conveying direction. FIG. 3B is a cross sectional view illustrating a sheet feed and separation area of a general sheet feeder employing a separation pad feeding system. FIG. 3C is an enlarged side view illustrating the sheet feed and separation area of FIG. 3B.

The sheet feeder having a general configuration as illustrated in FIGS. 3A through 3C includes the sheet tray 30 and a sheet feed roller 60. This sheet feeder employs a rotary system in which a receiver 63 rotates about a rotary shaft 63*b* disposed at a downstream side thereof. However, the configuration applicable to this disclosure is not limited thereto. For example, the rotary shaft 63*b* can be disposed at an upstream side of the receiver 63. Further, a separation pad having a direct acting type configuration in which the receiver 63 moves vertically and linearly is also applicable to this disclosure.

As illustrated in FIGS. 3B and 3C, a recess is formed on a top face of the receiver 63 and a pad attaching part 63*e* at the bottom of the recess to which the separation pad 64 is attached. A position regulating part 63*j* is formed by extending linearly from an upstream end of the pad attaching part 63*e* vertically. Further, a position regulating part 63*k* is formed by extending linearly from a downstream end of the pad attaching part 63*e* vertically.

As illustrated in FIGS. 3B and 3C, the separation pad 64 is attached to the pad attaching part 63*e*. A planar base material of the separation pad 64 is cut according to the size and shape of the pad attaching part 63*e* and is attached to the pad attaching part 63*e*.

The separation pad 64 may be formed of a various types of materials such as cork rubber and urethane foam rubber. The coefficient of friction of the separation pad 64 is usually set to a level higher than a coefficient of friction between sheets. By so doing, multifeed can be prevented due to the difference of the coefficient of friction of the separation pad 64 and that of sheets.

An uppermost sheet S placed on top of the bundles of sheets loaded on a sheet loading plate 61 provided in the sheet tray 30 is pressed by a pressing force of a compression spring 62. Accordingly, a sheet separation nip region N is formed, and therefore the uppermost sheet is conveyed one by one by driving of the sheet feed roller 60.

It is to be noted that, even though the compression spring 62 is employed as a pressure member of the sheet loading plate 61 in this configuration according to this disclosure, the pressure member is not limited thereto. For example, a member that applies a pressing force when the sheet feed roller 60 and the sheet loading plate 61 contact with each other can be applied to this disclosure.

Further, when multiple sheets S are fed together, the multiple sheets S are sandwiched in the sheet separation nip region formed between the sheet feed roller 60 and the separation pad 64. This sheet separation nip region is maintained in a state in which the sheet separation nip region is pressed with a given pressure applied by the separation spring 65.

Consequently, when a coefficient of friction between the sheet feed roller 60 and the sheet S is represented as "μr", a coefficient of friction between adjacent sheets is represented as "μp", and a coefficient of friction between the sheet S and the separation pad 64 is represented as "μf", a relation of these three coefficients of friction are described as:

$$\mu r > \mu f > \mu p.$$

Based on this relation, the uppermost sheet S alone is frictionally separated and fed.

In order to achieve better sheet conveying performance, the receiver 63 employs a resin material that is less expensive and has a lower coefficient of friction than the separation pad 64.

A leading end separator 63*a* is formed on an upstream side of the separation pad 64. The leading end separator 63*a* is a projection integrally formed with the receiver 63. The height of the leading end separator 63*a* is arranged higher than an upstream end 64*b* of the separation pad 64 by a given amount so that the leading end of the sheet S is not caught by the upstream end 64*b* of the separation pad 64.

In the above-described separation pad feeding system, when the sheet S enters and passes by the separation pad 64, the leading end of the sheet S may be folded due to a sheet conveyance load and cause misfeed.

However, the separation pad feeding system causes misfeed and leading edge fold of the sheets due to a load received by a sheet fed by the sheet feed roller when the sheet abuts against the separation pad. Various proposals have been made to prevent misfeed and leading edge fold of a sheet.

As an example of a separation pad feeding system, an elastic tongue piece is disposed at an upstream portion of the separation pad in a sheet feeding direction, extending toward the sheet feed roller. The elastic tongue piece reduces or narrows an angle of the sheet and the separation pad when the sheet is fed toward a sheet separation nip region formed between the sheet feed roller and the separation pad. The elastic tongue piece, however, is attached to the upstream portion of the separation pad with high accuracy. Accordingly, it is difficult to attach the elastic tongue piece accurately, and therefore the productivity of the sheet feeder cannot be enhanced.

Specifically, leading end fold and/or misfeed occur when the elastic tongue piece projects by an amount below the accurate amount thereof.

On the other hand, when the elastic tongue piece projects by an amount exceeding the accurate amount thereof, the elastic tongue piece contacts the sheet feed roller to reduce a pressing force (a separation force) generated in the sheet separation nip region and, as a result, defect of sheets such as misfeed occurs.

In order to reduce a load of a sheet entering toward the separation pad without increasing the difficulty of component assembly, a guide surface that is formed integrally with a receiver is extended in a downstream direction of sheet conveyance so that the sheet can be conveyed to the guide surface. By so doing, the sheet is conveyed to the guide surface having a smaller friction coefficient than the separation pad, and therefore a load of sheet conveyance can be reduced when the sheet enters thereto.

However, extension of the guide surface in the downstream direction can result in a reduction of the width of a gap between the sheet feed roller and the guide surface. Such a narrower gap between the sheet feed roller and the guide surface causes the sheet to elevate the receiver via the guide surface. Consequently, a sheet separating force decreases to cause failures such as multifeed.

As another example of a separation pad feeding system, the separation pad disposed upstream from the sheet separation nip region has an inclined surface that inclines in a direction separating from an upstream extension line of the sheet separation nip region. By so doing, the inclined surface can guide the sheet to the sheet separation nip region.

However, extension of the guide surface in the downstream direction can result in a reduction of the width of a gap between the sheet feed roller and the guide surface. If multiple sheets are fed in a form of a sheet bundle, the sheet bundle enters the sheet separation nip region without contacting the inclined surface of the separation pad, and therefore causes multifeed.

In addition, the inclined surface of the separation pad increases an angle of the separation pad in an upstream direction of sheet conveyance. Therefore, a sheet conveyance load increases when the leading end of the sheet enters the upstream side of the separation pad, and therefore failures such as misfeed can occur easily.

Further, the upstream side of the separation pad is bent at the inclined surface thereof while a downstream side thereof is not. Accordingly, it is difficult to attach the separation pad reliably.

The following examples are provided to effectively prevent a leading edge fold and/or misfeed that occur when the sheet S enters to pass through the separation pad 64.

Figure 4A:
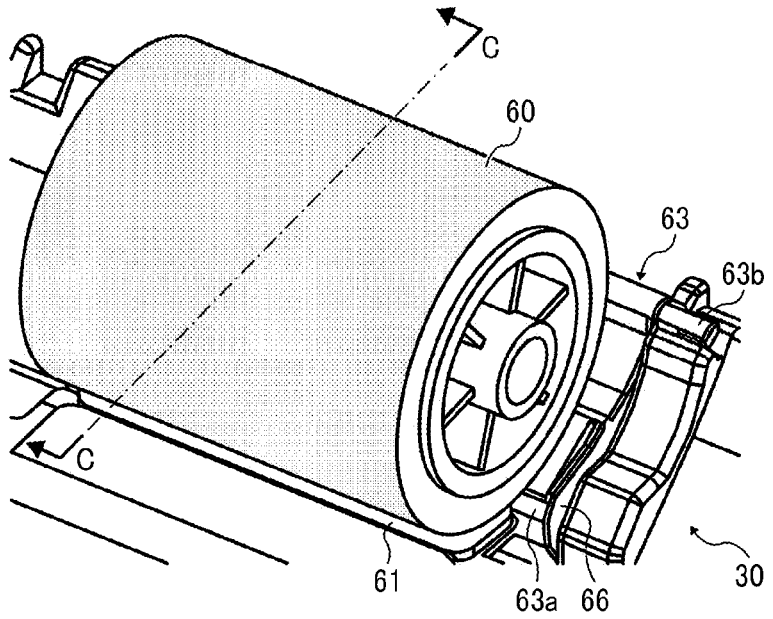
FIG. 4A is a perspective view illustrating a sheet feed and separation area of a sheet feeder according to an example of this disclosure.
Figure 4B:
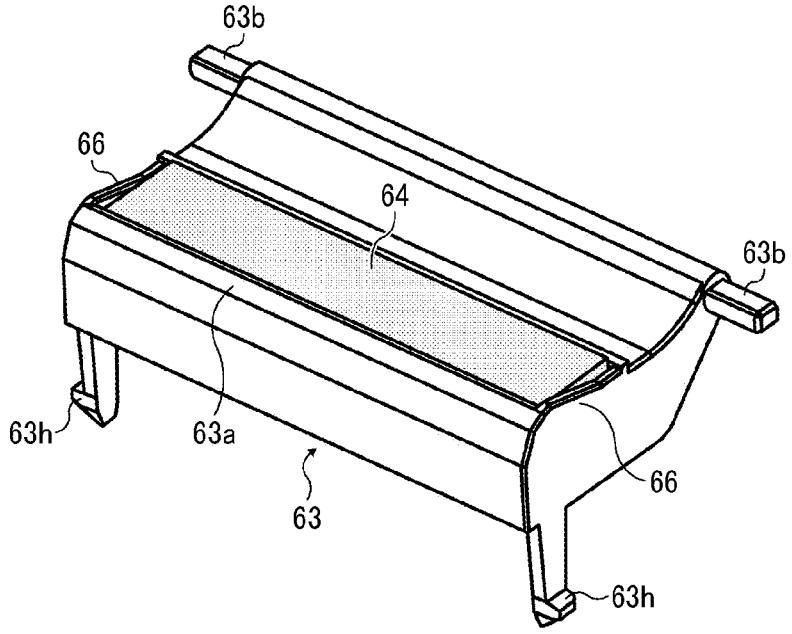
FIG. 4B is a perspective view illustrating a receiver provided to the sheet feeder.
Figure 4C:
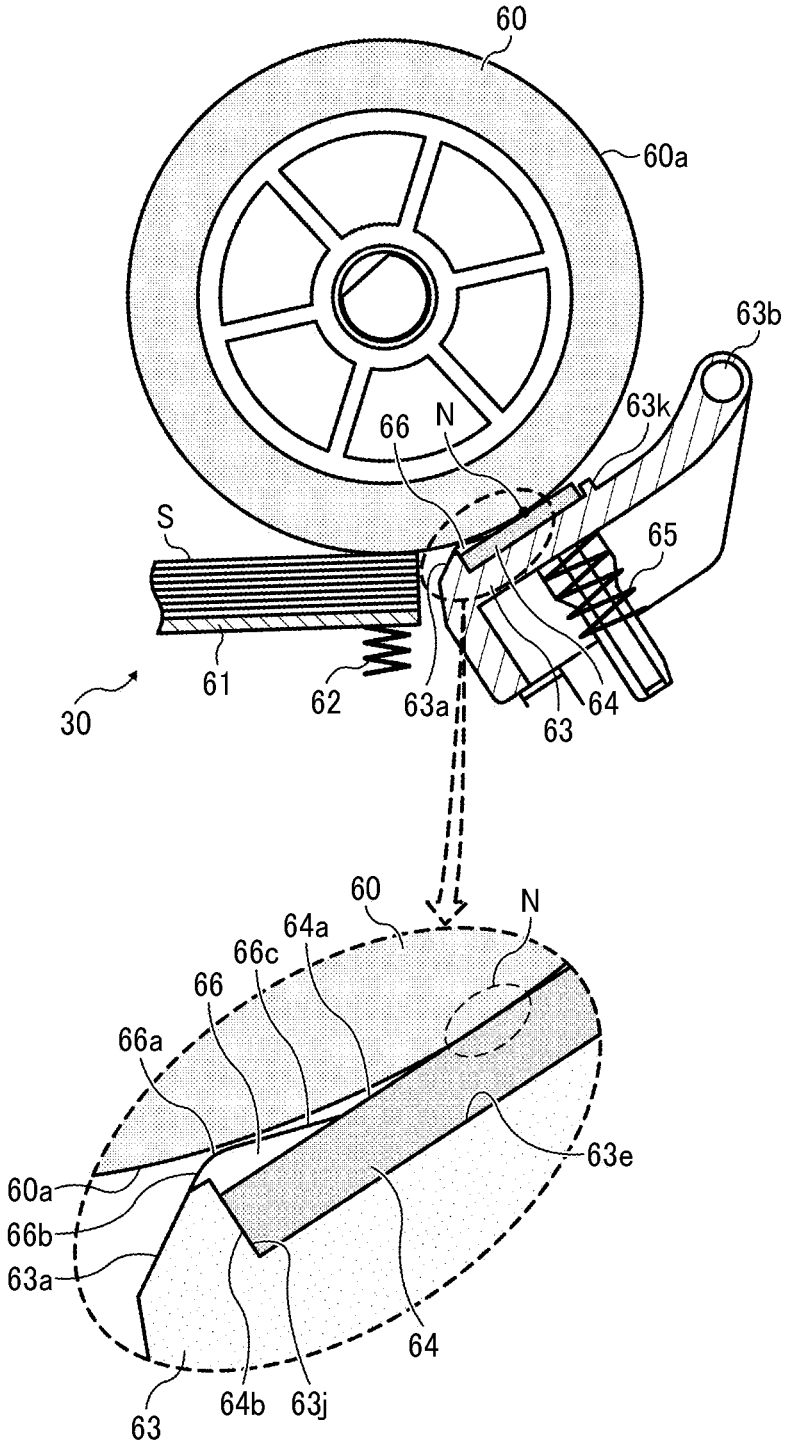
FIG. 4C is a side view illustrating the sheet feed and separation area of the sheet feeder.

At first, a description is given of a basic configuration of the sheet feeder 600 according to an example of this disclosure with reference to FIGS. 4A through 4C.

FIG. 4A is a perspective view illustrating a sheet feed and separation area in the sheet feeder 600. FIG. 4B is a perspective view illustrating the receiver 63 of the sheet feeder 600 of FIG. 4A. FIG. 4C is a cross sectional view illustrating the sheet feed and separation area along a line C-C of FIG. 4A.

Reference numeral 63*h* in FIG. 4B indicates stoppers to regulate a range of rotation of the receiver 63 by the separation spring 65.

In this example, the receiver 63 includes projections at both ends thereof in a direction perpendicular to the sheet conveying direction or a width direction. The projections 66 are formed integrally with the receiver 63 and are disposed outwardly from both ends in the width direction of the sheet feed roller 60 and the separation pad 64. Respective top faces 66*a* of the projections 66 are disposed upstream from the sheet separation nip region N of the separation pad 64 and projecting upwardly from a surface 64*a* of the separation pad 64.

The projections 66 formed integrally with the receiver 63 reduce the number of parts, and therefore a tooling cost can be reduced. In addition, a production cost to attach the projections 66 to the receiver 63 can be reduced. Further, by disposing the projections 66 outwardly from both ends in the width direction of the separation pad 64, the projections 66 can be formed without making the shape of the separation pad 64 more complex.

Each top face 66*a* of the projections 66 is disposed above the surface 64*a* of the separation pad 64, so that the leading end of the sheet S contacts the top face 66*a* of the projections 66 to be guided to the separation pad 64 reliably. Accordingly, when the sheet S enters the sheet separation nip region, the angle of the sheet S and the separation pad 64 becomes more acute, that is, the leading end of the sheet S moves more parallel to the surface 64*a* of the separation pad 64. Consequently, the sheet conveyance load on the sheet S can be reduced. As a result, leading end fold and misfeed of the sheet S can be prevented effectively.

As an alternative way of reducing the sheet conveyance load on the sheet S, the leading end separator 63*a* is extended in a downstream direction so that the leading end of the sheet S is received by the leading end separator 63*a*. However, the leading end separator 63*a* is disposed at a position higher than the upstream end 64*b* of the separation pad 64 by a given amount so that the leading end of the sheet S is not caught by the upstream end 64*b* of the separation pad 64. Therefore, if the leading end separator 63*a* is extended in the downstream direction, an amount of a gap A (see FIG. 5B) between the sheet feed roller 60 and the leading end separator 63*a* is reduced.

The gap A generally has a given amount so that at least the leading end of the sheet S can enter the sheet separation nip region reliably. This amount of the gap A depends on property, thickness, and operating environment of a sheet to enter the sheet separation nip region N.

The amount of the gap A is greater than at least the thickness of a sheet. If the amount of the gap A is smaller than the thickness of a sheet, the leading end of the sheet S cannot enter the sheet separation nip region, which can cause misfeed of the sheet S. Further, the amount of the gap A has a certain margin to the thickness of a sheet. If the amount of the gap A has no margin or a relatively small margin, a contact force applied between the sheet S and the receiver 63 increases, and therefore a force applied to press the receiver 63 downwardly also increases. The increase in this force reduces the sheet separating pressure in the sheet separation nip region N and, as a result, misfeed of the sheet S occurs.

In order to prevent such a reduction in the sheet separating pressure, the projections 66 are disposed outwardly from both ends in the width direction of the sheet feed roller 60 and the separation pad 64. By disposing the projections 66 as described above, even when a thick paper enters the sheet separation nip region N, the force that presses down the receiver 63 can be reduced.

In addition, the top face 66*a* of each of the projections 66 is disposed at a position lower than an outer circumferential surface 60*a* of the sheet feed roller 60. There are two reasons to locate the top face 66*a* of the projections 66 lower than the outer circumferential surface 60*a* of the sheet feed roller 60.

For one reason, if the top face 66*a* of the projections 66 is higher than the outer circumferential surface 60*a* of the sheet feed roller 60, a part of the sheet S between the sheet feed roller 60 and each of the projections 66 warps into a recess when viewed in the sheet conveying direction.

The recess of the sheet S has a relatively strong rigidity, which increases a force applied from the sheet S to the projections 66 or the separation pad 64. The increased force presses down the receiver 63 to cause a reduction in sheet conveying force and/or multifeed of the sheets S due to a reduction of sheet separating pressure.

For the other reason, if the position of the projections 66 is higher than the outer circumferential surface 60*a* of the sheet feed roller 60, the sheet S gets caught by the projections 66, which can result in misfeed of the sheet S.

By disposing the top face 66*a* of each of the projections 66 at a position lower than the outer circumferential surface 60*a* of the sheet feed roller 60, the above-described inconveniences can be prevented.

As described above, the sheet feeder 600 according to the present example of this disclosure provides the configuration in which the projections 66 are disposed as a pair of projections outwardly from on both left and right ends in the width direction, which is a direction perpendicular to the sheet conveying direction, of the sheet feed roller 60 and the separation pad 64. The top face 66*a* of each of the projections 66 is disposed closer to the sheet feed roller 60 and lower than the outer circumferential surface 60*a* of the sheet feed roller 60. According to this positional arrangement, multifeed, leading end fold, and misfeed of the sheet S can be prevented.

Next, a description is given of evaluation results of sheet feeding test using the sheet feeder 600 provided with various types of receivers 63. In the sheet feeding test, five types of receivers 63 and multiple parameters are used.

Figures 5A, 5B:
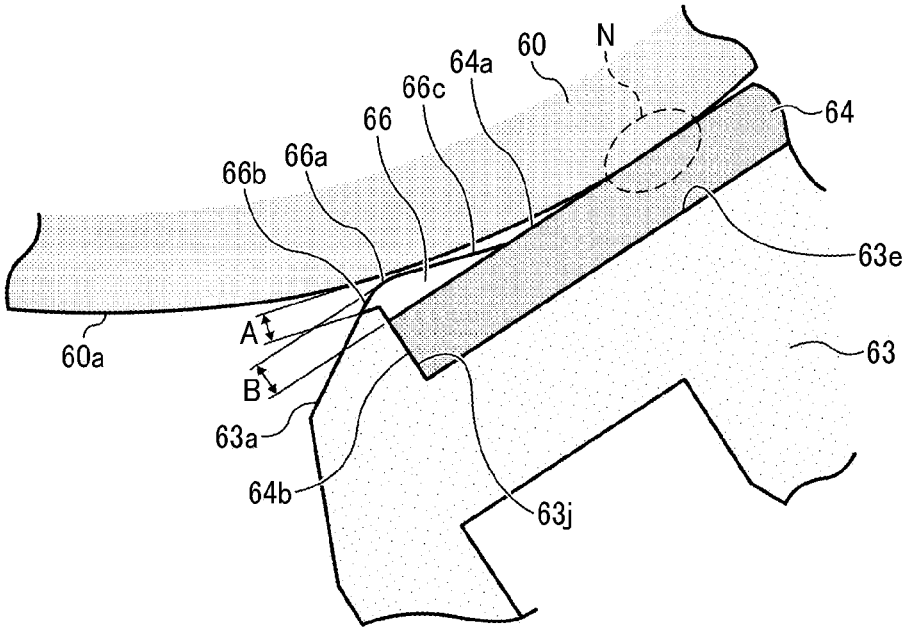
FIG. 5A is a table showing test results of the sheet feeder.
FIG. 5B is an enlarged side view illustrating the receiver of the sheet feeder used for the test.
Figure 6A:
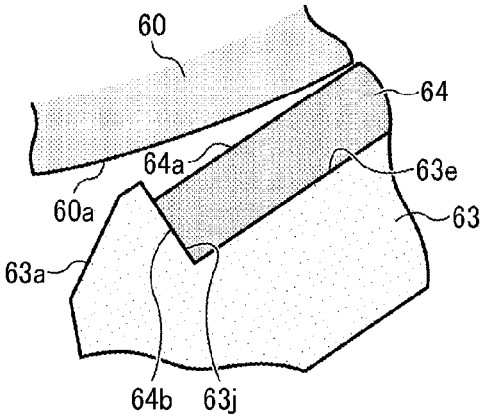
FIGS. 6A through 6E are enlarged side views illustrating the receiver used in the test for the sheet feeder.
Figure 6B:
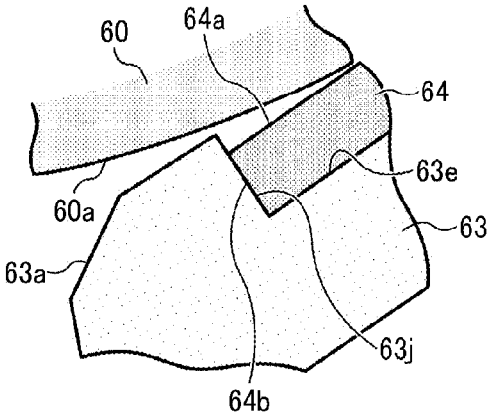
Figure 6C:
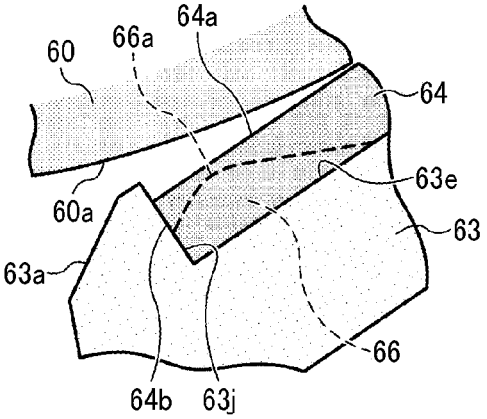
Figure 6D:
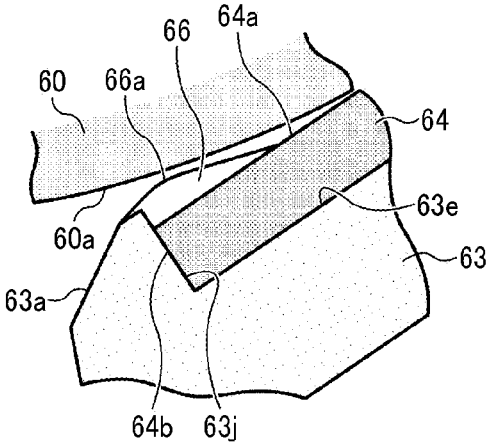
Figure 6E:
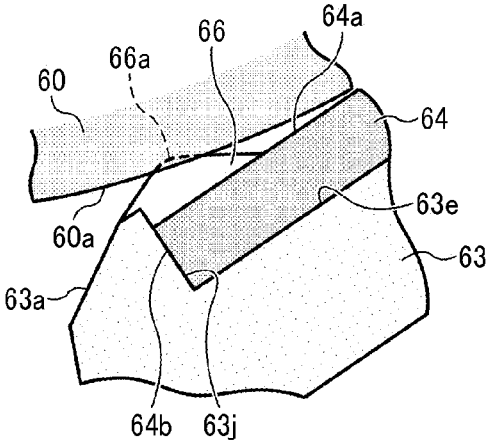

FIG. 5A is a table showing the test results of sheet feeding in the sheet feeder 600 according to this example of this disclosure. FIG. 5B is an enlarged cross sectional side view illustrating a selected one of the receivers 63 used in the test. FIGS. 6A through 6E are enlarged cross sectional side views illustrating the receivers 63 used in the test for the sheet feeder 600.

As illustrated in FIGS. 5A and 5B, this test was conducted and evaluated with the sheet feeder 600 equipped with each of five receivers 63 under conditions 1 through 5 and two parameters, which are the amount of the gap A between the leading end separator 63*a* and the sheet feed roller 60 and a height B of the top face 66*a* of each of the projections 66. The test was conducted with the receivers 63 under conditions 1 through 5 having identical condition settings except for respective shapes. With this configuration, occurrence of multifeed, leading end folding, and misfeed was checked.

The gap A between the leading end separator 63*a* and the sheet feed roller 60 has two types, which are a large gap indicated in the table of FIG. 5A as LARGE and a small gap indicated as SMALL. The small gap (SMALL) is a gap relatively smaller than the receiver 63 illustrated in FIG. 3B with no margin to a thickness of a sheet. The large gap (LARGE) is a gap substantially equal to the receiver 63 illustrated in FIG. 3B with a certain margin to a thickness of a sheet.

The receivers 63 under conditions 1 through 5 have the following shapes different from each other.

Condition 1: Same shape as the receiver 63 illustrated in FIG. 3B (Gap A: LARGE, Height B: No projection).

Condition 2: Same shape as the receiver 63 illustrated in FIG. 3B with the leading end separator 63*a* extending in the downstream direction (Gap A: SMALL, Height B: No projection).

Condition 3: Projections 66 provided (Gap A: LARGE, Height B: Below the surface 64*a* of the separation pad 64).

Condition 4: Projections 66 provided (Gap A: LARGE, Height B: Above the surface 64*a* of the separation pad 64 and below the outer circumferential surface 60*a* of the sheet feed roller 60 or between the surface 64*a* of the separation pad 64 and the outer circumferential surface 60*a* of the sheet feed roller 60).

Condition 5: Projections 66 provided (Gap A: LARGE, Height B: Above the outer circumferential surface 60*a* of the sheet feed roller 60).

As illustrated in the table of FIG. 5A, while the leading end fold occurred under Condition 1 (no projection), both the misfeed and the leading end fold were prevented under Condition 4 (with projections). In addition, the leading end fold was prevented by extending the leading end separator 63*a* in the downstream direction but the misfeed occurred under Condition 2.

Even though the receiver 63 under Condition 3 has the projections 66, the leading end fold could not be prevented due to short of height of the projections 66. Even though the receiver 63 under Condition 5 has the projections 66, not only the multifeed but also the leading end fold and the misfeed occurred. It was confirmed that the leading end fold and the misfeed were caused because the sheet S was caught by the projections 66.

As described above, it was confirmed that the receiver 63 under Condition 4 can prevent the leading end fold and the misfeed occurred in the receiver 63 illustrated in FIG. 3B. Further, by extending the top face 66*a* of the projections 66, the receiver 63 under Condition 4 can also prevent the multifeed occurred in the receiver 63 under Conditions 3 and 5.

Figure 7A:
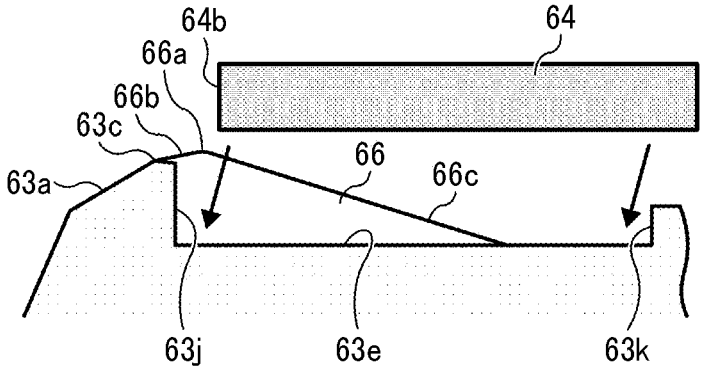
FIG. 7A is a side view illustrating a separation pad before attached to the receiver of the sheet feeder.
Figure 7B:
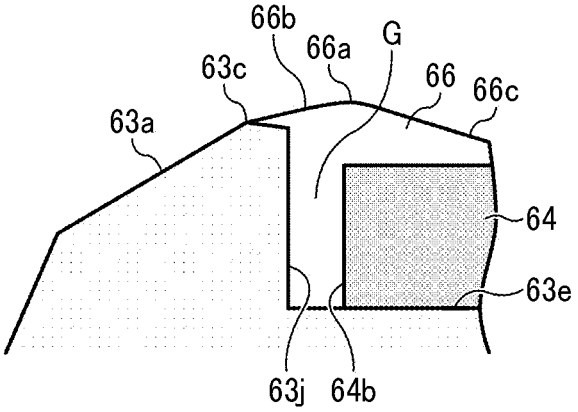
FIG. 7B is a side view illustrating the separation pad after attached to the receiver of the sheet feeder.
Figure 8A:
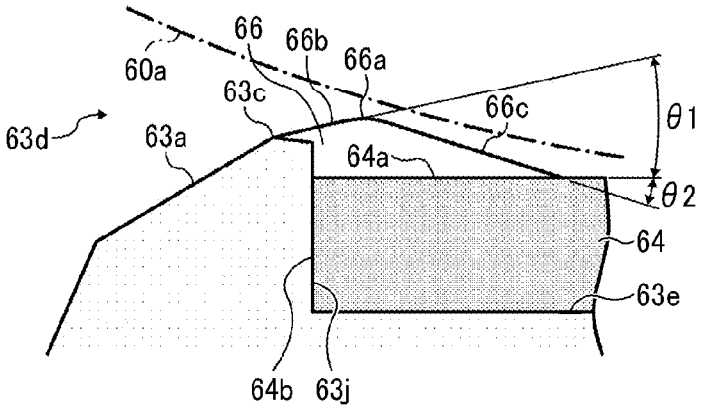
FIG. 8A is an enlarged side view illustrating an upstream end of the receiver according to an example of this disclosure.

Next, a description is given of a detailed configuration of the receiver 63 and the projections 66 with reference to FIGS. 7A, 7B, and 8A.

FIG. 7A illustrates the separation pad 64 before being attached to the receiver 63 of the sheet feeder 600. FIG. 7B illustrates the separation pad 64 after attached to the receiver 63 of the sheet feeder 600 in a state in which a gap is formed between the position regulating part 63*j* located at the downstream side of the leading end separator 63*a* and the upstream end 64*b* of the separation pad 64 due to attachment failure of the separation pad 64. FIG. 8A is an enlarged cross sectional side view illustrating an upstream end 63*d* of the receiver 63 with the separation pad 64 attached properly.

As illustrated in FIG. 7B, in a case in which a gap G is formed between the position regulating part 63*j* and the upstream end 64*b* of the separation pad 64 due to attachment failure of the separation pad 64, the sheet S having a downwardly curled leading end is caught by the upstream end 64*b* of the separation pad 64, which can result in occurrence of the leading end fold and the misfeed of the sheet S.

In order to prevent the leading end fold and the misfeed of the sheet S caused by attachment failure of the separation pad 64, the top face 66*a* of each of the projections 66 is formed at an upper part of the upstream end 64*b* of the separation pad 64. By so doing, even if the gap G is formed due to attachment failure of the separation pad 64, the sheet S is guided to the sheet separation nip region N by the top face 66*a* of each of the projections 66 without being caught by the upstream end 64*b* of the separation pad 64.

Further, since the projections 66 are located at both ends of the receiver 63, the projections 66 function as regulators to prevent the separation pad 64 from being misaligned in the width direction when attaching the separation pad 64. In addition, it is preferable that the top face 66*a* of each of the projections 66 illustrated in FIG. 8A is disposed higher than a top face 63*c* of the leading end separator 63*a*. By so doing, when the leading end of the sheet S enters the receiver 63, the projections 66 guide the sheet S upwardly temporarily. Accordingly, when the sheet S enters the sheet separation nip region, the angle of the sheet S and the separation pad 64 becomes more acute (i.e., the leading end of the sheet S moves more parallel to the surface 64*a* of the separation pad 64), and therefore the sheet conveyance load on the sheet S can be reduced.

Next, a description is given of a configuration of the projections 66 with reference to FIG. 8A.

A first inclined surface 66*c* is formed at a downstream from the top face 66*a* of the projections 66 and a second inclined surface 66*b* is formed at an upstream from the top face 66*a* of the projections 66.

It is preferable that an angle θ1 of the second inclined surface 66*b* relative to the surface 64*a* of the separation pad 64 is set to be 45 degrees or smaller. It is more preferable that the angle θ1 is set to be 30 degrees or smaller. Accordingly, when the sheet S enters the sheet separation nip region, the angle of the sheet S and the second inclined surface 66*b* becomes more acute (i.e., the leading end of the sheet S moves more parallel to the surface 64*a* of the separation pad 64). Consequently, the misfeed due to excess of the sheet conveyance load on the sheet S can be prevented.

Further, it is preferable that an angle θ2 of the first inclined surface 66*c* relative to the surface 64*a* of the separation pad 64 is set to be 90 degrees or smaller. It is more preferable that the angle θ2 is set to be 45 degrees or smaller. Accordingly, when the sheet S leaves from the first inclined surface 66*c*, the trailing end of the sheet S is restrained from unstable motion thereof. Consequently, the sheet S can be prevented from colliding with the surface 64*a* of the separation pad 64 and, as a result, a reduction in noise (sound) can be enhanced.

Further, it is preferable that an angle (θ1+θ2) of the first inclined surface 66*c* and the second inclined surface 66*b* is set to be 45 degrees or smaller. Accordingly, when the sheet S enters the sheet separation nip region, the angle of the sheet S and the second inclined surface 66*b* located at the upstream side in the sheet conveying direction becomes more acute (i.e., the leading end of the sheet S moves more parallel to the surface 64*a* of the separation pad 64). Consequently, the misfeed due to excess of the sheet conveyance load on the sheet S can be prevented.

Further, the top face 66*a* of each of the projections 66 is formed as a ridgeline or outline connecting the first inclined surface 66*c* and the second inclined surface 66*b* with a curved surface or at a small angle that cannot be confirmed visually. Accordingly, the sheet conveyance load can be reduced to prevent damage to the sheet S and wear of the projections 66 can be reduced.

As illustrated in FIG. 8A, the second inclined surface 66*b* and the leading end separator 63*a* (i.e., both ends in a width direction of the leading end separator 63*a*) are continuously arranged on the same straight line in the sheet conveying direction. According to this configuration, the sheet S can be forwarded from the leading end separator 63*a* to the second inclined surface 66*b* smoothly. Therefore, the sheet conveyance load applied when the sheet S moves to the second inclined surface 66*b* is reduced, and molding of the receiver 63 becomes simpler.

Next, a description is given of a configuration of the projections 66 according to another example of this disclosure, with reference to FIGS. 8B, 8C, 9A, and 9B.

Figure 8B:
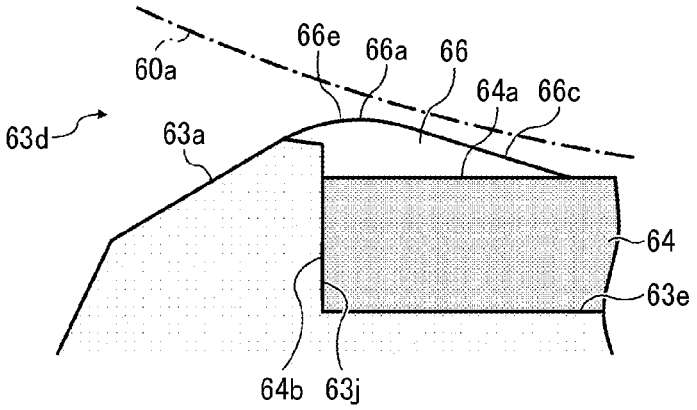
FIG. 8B is an enlarged side view illustrating the upstream end of the receiver according to another example of this disclosure.
Figure 8C:
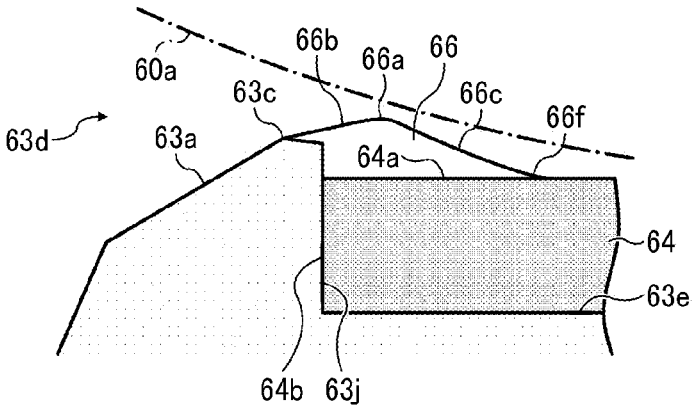
FIG. 8C is an enlarged side view illustrating the upstream end of the receiver according to yet another example of this disclosure.
Figure 9A:
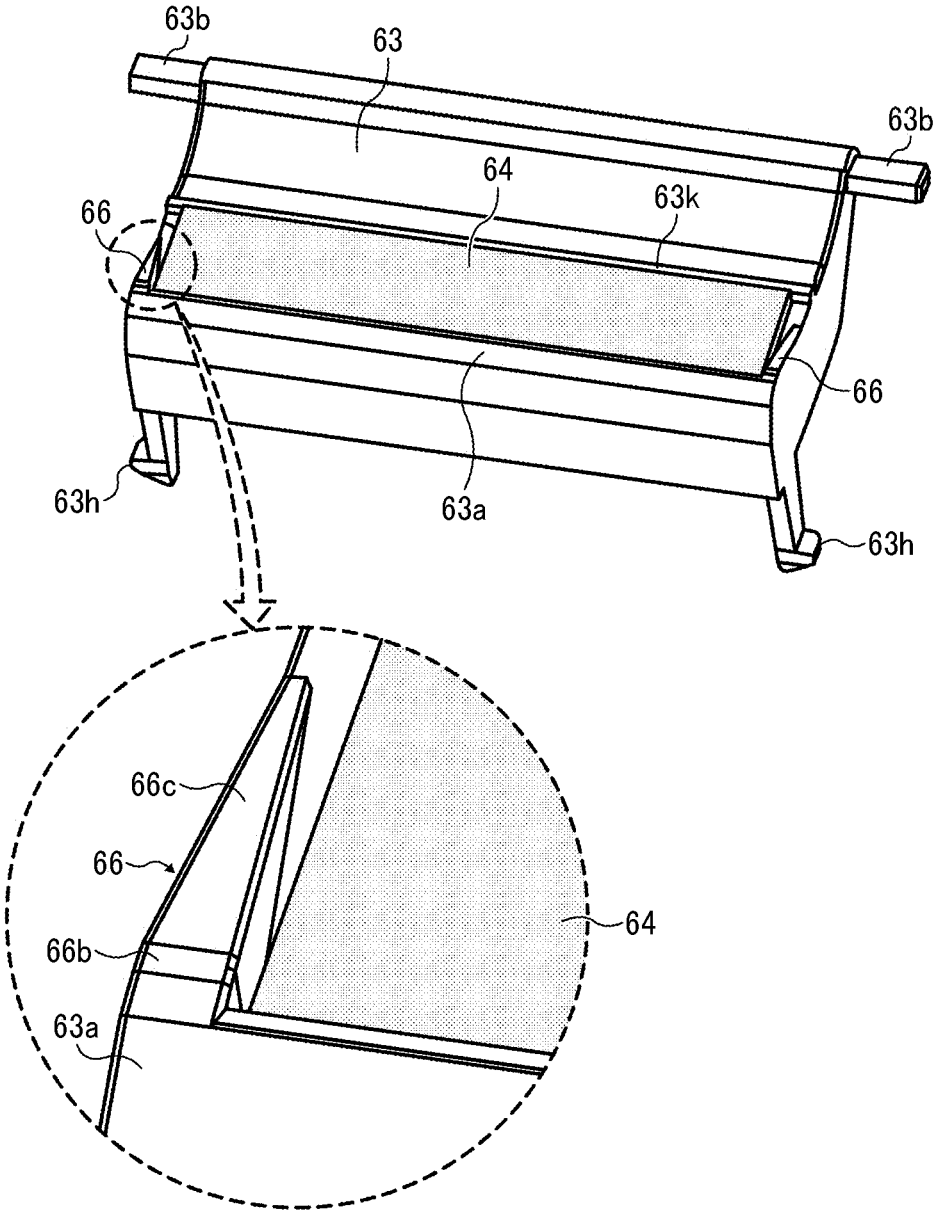
FIG. 9A is a perspective view illustrating the receiver of the sheet feeder according to an example of this disclosure.
Figure 9B:
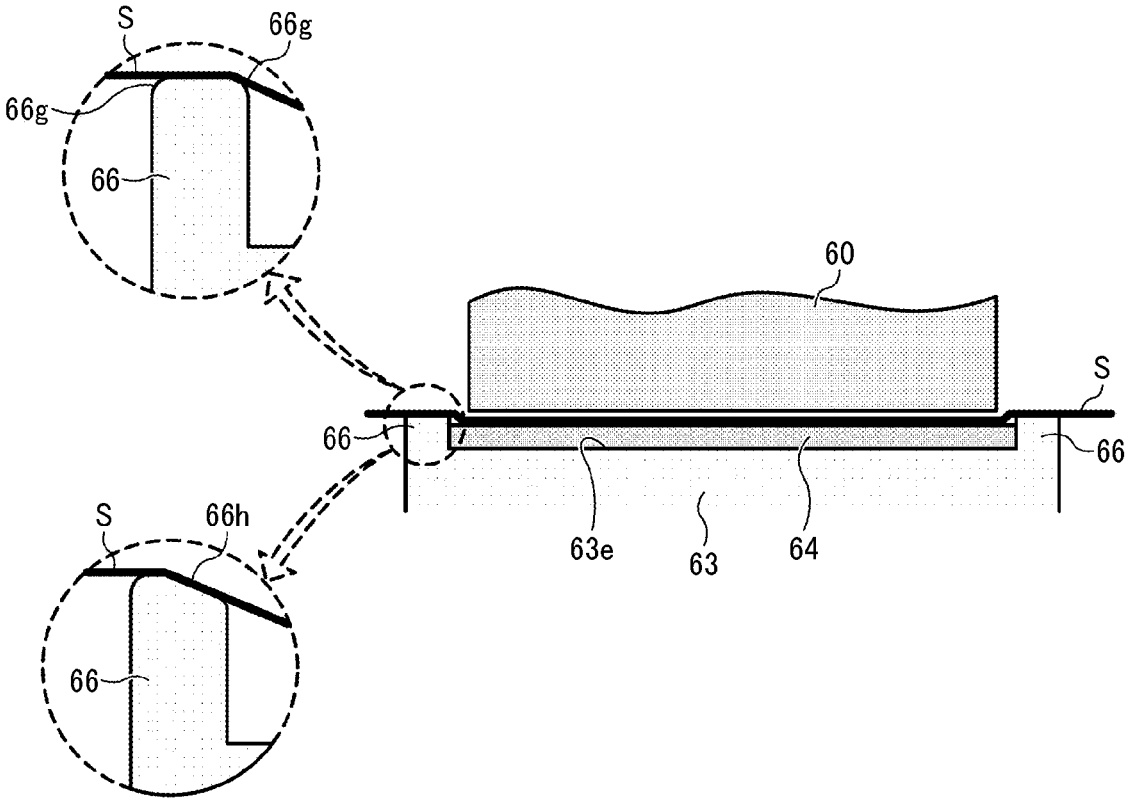
FIG. 9B is a front view illustrating the receiver of the sheet feeder of FIG. 9A.

FIG. 8B is an enlarged side view illustrating the upstream end of the receiver 63 according to another example of this disclosure. FIG. 8C is an enlarged side view illustrating the upstream end of the receiver 63 according to yet another example of this disclosure. FIG. 9A is a perspective view illustrating the receiver 63 of the sheet feeder 600 according to an example of this disclosure. FIG. 9B is a front view illustrating the receiver 63 of the sheet feeder 600 of FIG. 9A.

Different from the second inclined surface 66*b* having a flat surface as illustrated in FIG. 8A, the second inclined surface 66*b* in a configuration of this example may have a projecting part 66*e* having a projecting surface, an outline of which is curved outwardly toward the sheet feed roller 60 as illustrated in FIG. 8B. According to this configuration, the projecting part 66*e* of the second inclined surface 66*b* near the top face 66*a* of the projections 66 gradually forms a gentler angle, and therefore the sheet S can move aground the second inclined surface 66*b* smoothly. Consequently, the sheet conveyance load can be reduced to prevent misfeed of the sheet S and damage to the sheet S and wear of the projections 66 can be reduced.

Alternatively, different from the first inclined surface 66*c* having a flat surface as illustrated in FIG. 8A, the first inclined surface 66*b* in a configuration of this example may have a recessed part 66*f* having a recessed surface, an outline of which is curved outwardly from the sheet feed roller 60, that is, curved inwardly toward the surface 64*a* of the separation pad 64 near a point at which the first inclined surface 66*c* intersects the surface 64*a* of the separation pad 64, as illustrated in FIG. 8C. Accordingly, as the sheet S moves to the sheet separation nip region in the downward direction, the angle of leading end of the sheet S relative to the surface 64*a* of the separation pad 64 becomes more acute, that is, the leading end of the sheet S moves more parallel to the surface 64*a* of the separation pad 64. Consequently, the sheet S can enter the sheet separation nip region to the surface 64*a* of the separation pad 64 smoothly. Consequently, the sheet conveyance load can be reduced to prevent misfeed and the sheet S can be prevented from colliding with the surface 64*a* of the separation pad 64 to enhance a reduction in noise (sound).

Further, different from the projections 66 having the first inclined surface 66*c* and the second inclined surface 66*b* both having a contact width as illustrated in FIG. 4B, the first inclined surface 66*c* and the second inclined surface 66*b* of the projections 66 may have a width becoming narrower gradually from the upstream side to the downstream side, as illustrated in FIG. 9A. Accordingly, by providing the first inclined surface 66*c* and the second inclined surface 66*b* having a tapered width toward the downstream side, the leading end of the sheet S is received by the second inclined surface 66*b* so as to disperse the sheet conveyance load. When the trailing end of the sheet S passes therethrough, the sheets S slides and contacts the first inclined surface 66*c* having a narrow width, so as to reduce the sheet conveyance load and the damage to the sheet S.

FIG. 9B illustrates the sheet feed and separation area of the sheet feeder 600, viewed from the sheet feeding direction.

As illustrated in FIG. 9B, each of the projections 66 has respective rounded surfaces 66*g* at both left and right corners such that the rounded surfaces 66*g* project toward the sheet feed roller 60. The sheet S contacts the rounded surfaces 66*g*, each outline of which is curved outwardly to the sheet feed roller 60. The sheet conveyance load applied on the sheet S when contacting the rounded surfaces 66*g* of the projections 66 can be smaller than the sheet conveyance load applied on the sheet S when contacting surfaces of square corners or non-rounded surfaces of the projections 66.

Since a center area of the sheet S is pressed down due to contact with the sheet feed roller 60, an inside end of a top surface of the projections 66 contracts the sheet S more than the other part of the projections 66. The inside end of the top surface of the projections 66 according to this example has an inclined surface 66*h* that is sloped downwardly toward the center in the sheet width direction. The inclined surface 66*h* is inclined downwardly more to the inside or center part of the projections 66. Specifically, the inclined surface 66*h* is inclined more downwardly to the separation pad 64 toward the center part of the projections 66 in a width direction that is perpendicular to the sheet conveying direction. By so doing, the sheet S makes surface contact with the rounded surfaces 66*g* on the surface. The surface contact of the sheet S with the rounded surfaces 66*g* can reduce the sheet conveyance load applied on the sheet S more than a case in which the sheet S makes point contact at square corners or on non-rounded surfaces of the projections 66.

Figure 10A:
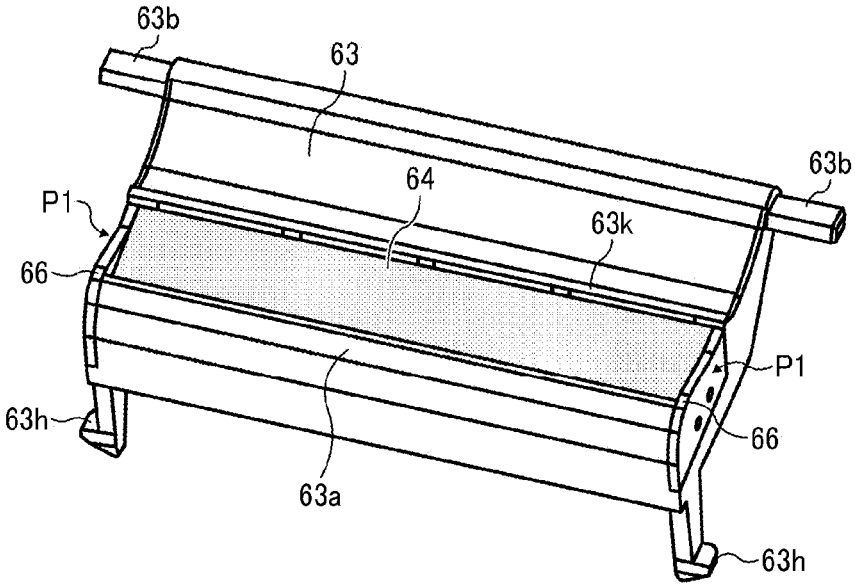
FIG. 10A is a perspective view illustrating a receiver provided to the sheet feeder according to another example of this disclosure.
Figure 10B:
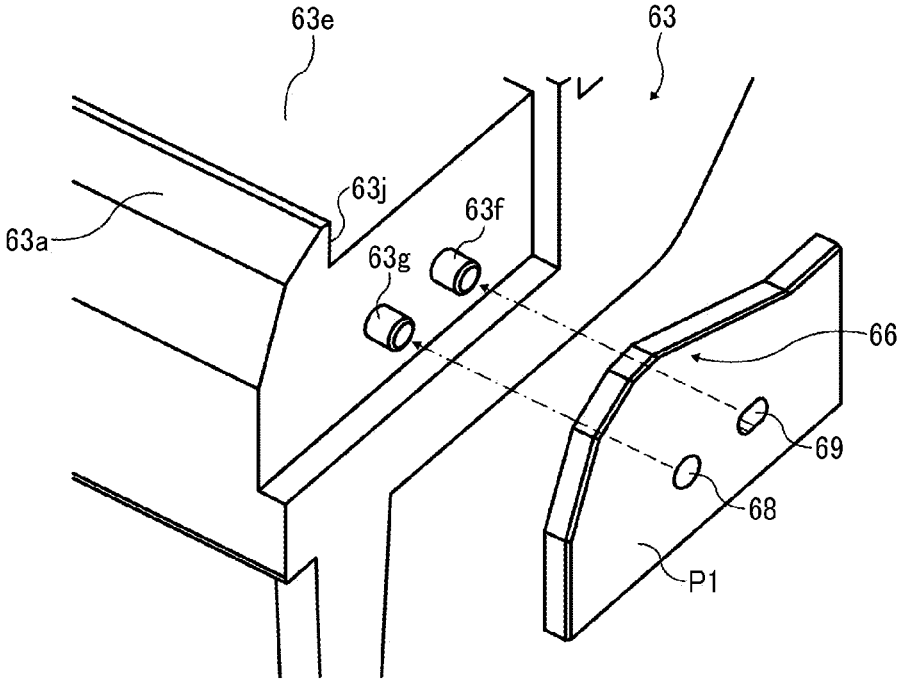
FIG. 10B is a perspective view illustrating an assembly of the receiver of FIG. 10A.

Next, a description is given of the configuration of the sheet feeder 600 of the image forming apparatus 100 according to another example of this disclosure with reference to FIGS. 10A and 10B.

The configuration of the projections 66 of the sheet feeder 600 according to this example is basically identical to the configuration of the projections 66 of the sheet feeder 600 according to the previous example. Except, the sheet feeder 600 according to this example includes a guide plate P1 having the projections 66 and is provided to the sheet feeder 600 separately from the receiver 63. The guide plate P1 functions as an attachment to the receiver 63.

In this example, the receiver 63 includes short engaging shafts 63*f* and 63*g* as a pair of engaging shafts. The short engaging shafts 63*f* and 63*g* are disposed vertically on both sides of the receiver 63.

The guide plate P1 also has two through holes formed on a side surface thereof. The through holes are a round opening 68 and a lateral elliptical opening 69. The round opening 68 and the lateral elliptical opening 69 pass through the guide plate P1 in a thickness direction of the guide plate P1 and are commonly usable at either sides of the receiver 63.

Accordingly, the projections 66 formed on the guide plate P1 can be replaced with a whole guide plate P1. By so doing, the projections 66 can be changed or modified to different shapes and materials according to the properties of the sheets S and worn projections 66 can be replaced to a new one. By forming multiple combinations of the round opening 68 and the lateral elliptical opening 69 on the side surface of the guide plate P1, the position of the projection 66 can be adjusted easily, and therefore an optimal position of the projections 66 can be selected according to the properties of the sheet.

Specifically, for example, by vertically shifting the guide plate P1, the projections 66 are raised when a largely burred sheet that tends to generate a leading end fold and the projections 66 are lowered when a sheet having a high coefficient of friction between sheets which tend to cause multifeed easily.

Figure 11:
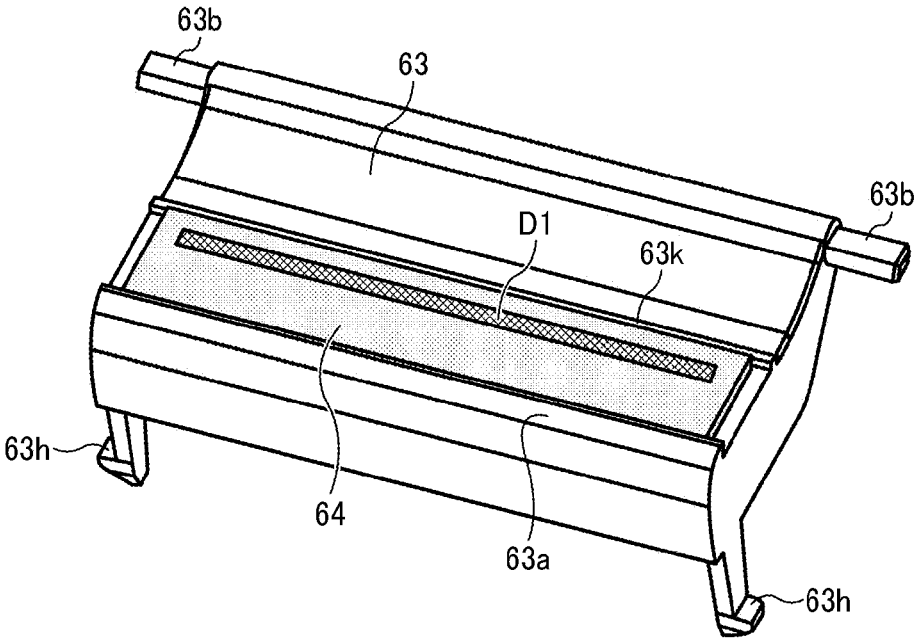
FIG. 11 is a perspective view illustrating a receiver provided to a comparative sheet feeder.
Figure 12A:
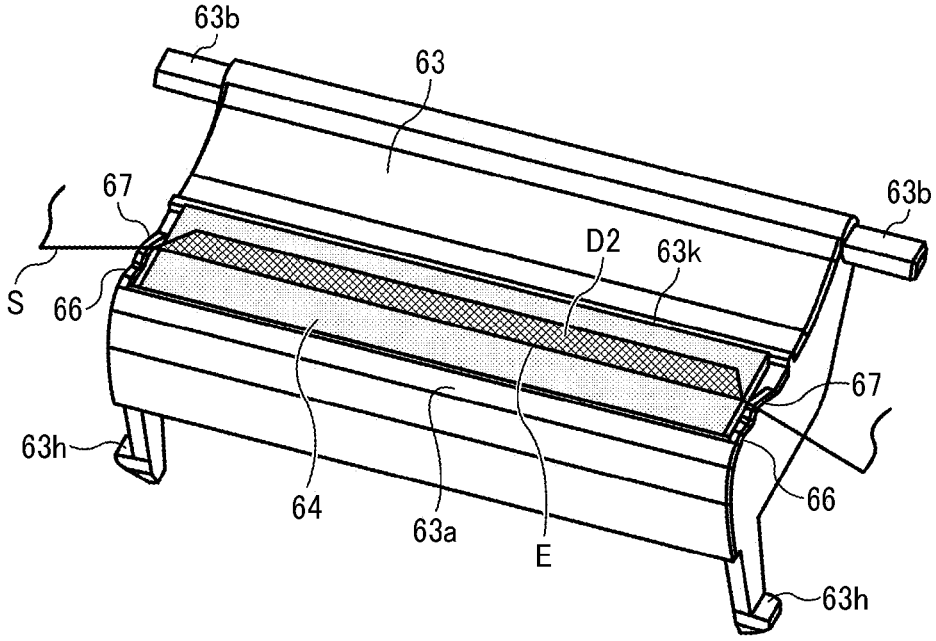
FIG. 12A is a perspective view illustrating a receiver provided to the sheet feeder according to yet another example of this disclosure.
Figure 12B:
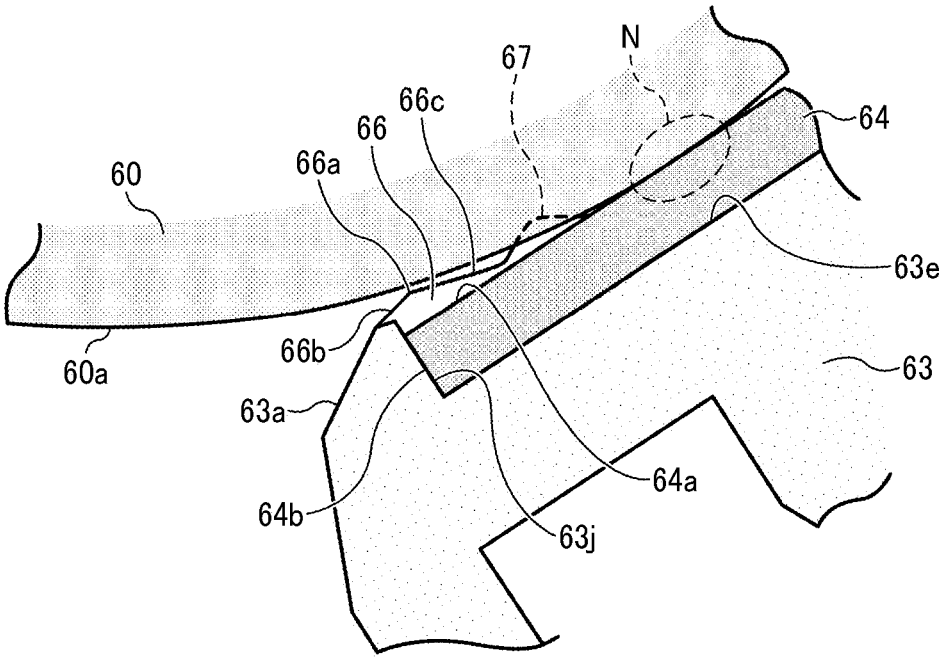
FIG. 12B is an enlarged side view illustrating the receiver of the sheet feeder of FIG. 12A.
Figure 12C:
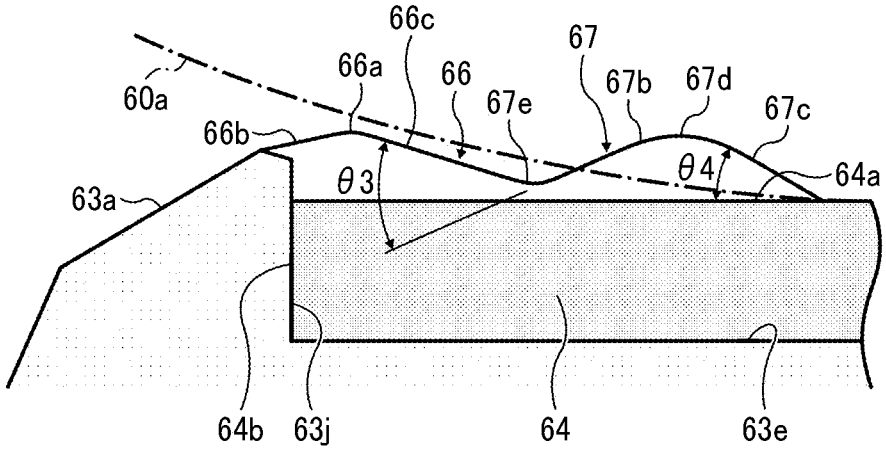
FIG. 12C is an enlarged side view illustrating the receiver of the sheet feeder of FIG. 12A.
Figure 13:
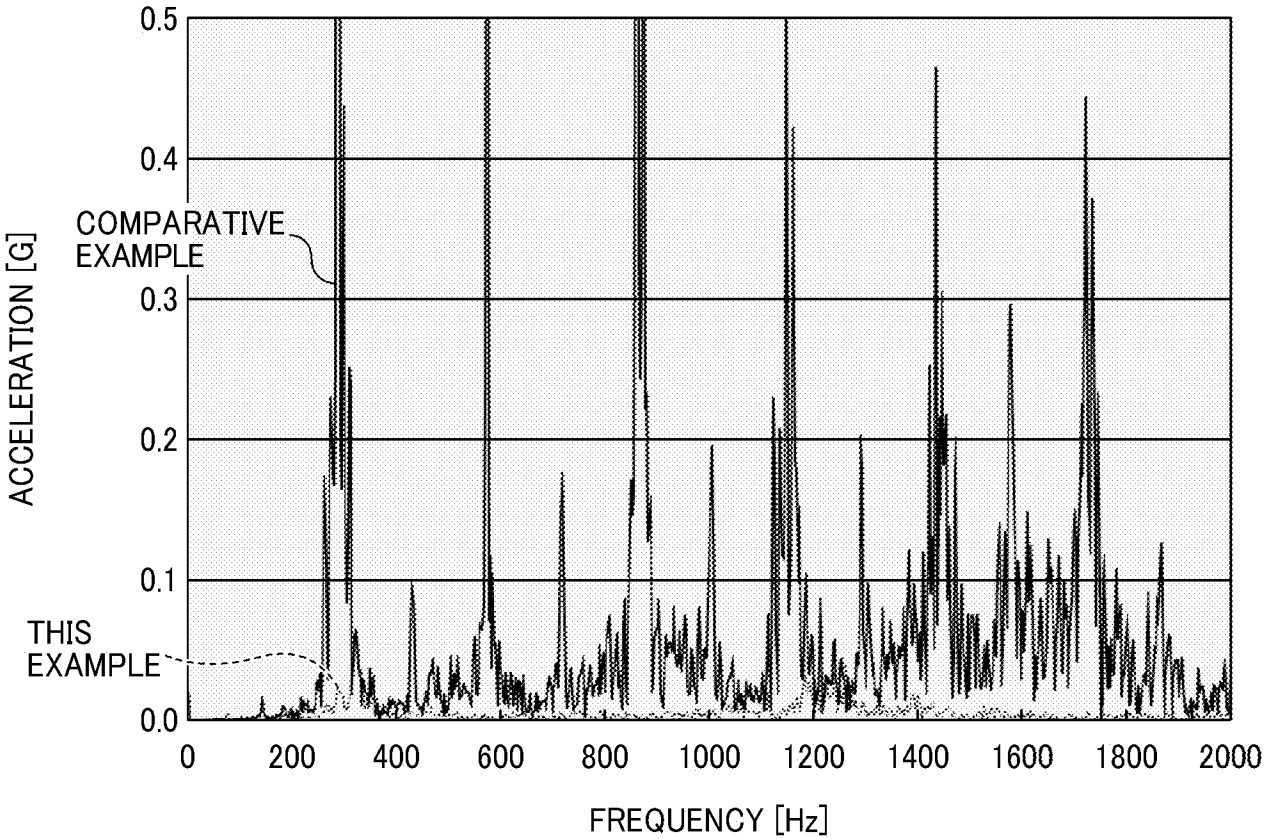
FIG. 13 is a graph showing test results of vibration accelerations when the sheet feeder of FIG. 12A and the comparative sheet feeder.

Next, a description is given of the configuration of the sheet feeder 600 of the image forming apparatus 100 according to another example of this disclosure with reference to FIGS. 11 through 13.

FIG. 11 is a perspective view illustrating a receiver provided to a comparative sheet feeding device. FIG. 12A is a perspective view illustrating the receiver 63 provided to the sheet feeder 600 according to yet another example of this disclosure. FIG. 12B is an enlarged side view illustrating the receiver 63 of the sheet feeder 600 of FIG. 12A. FIG. 12C is an enlarged side view illustrating the receiver 63 of the sheet feeder 600 of FIG. 12A. FIG. 13 is a graph showing test results of vibration accelerations when the sheet feeder 600 of FIG. 12A and the comparative sheet feeder of FIG. 11.

In this example, a second projection 67 is disposed downstream from the projections 66 in the sheet conveying direction and upstream from the sheet separation nip region N. The second projection 67 has a known structure to a pair of guides to prevent noise.

The configuration of the sheet feeder 600 according to this example includes both the projections 66 and the second projection 67 to address inconveniences such as leading end fold, misfeed, multifeed, and noise (abnormal sound). Specifically, the image forming apparatus employing the separation pad feeding system may generate noise (abnormal sound) due to vibration of stick-slip in the sheet separation nip region N other than leading end fold, misfeed, and multifeed. One of causes of vibration of stick-slip is that the sheet separation nip region N is narrow and unstable.

The region of the sheet separation nip region N formed between the sheet S and the separation pad 64 is illustrated as a region D1 having a narrow and long area in FIG. 11. The region D1 extends in a horizontal direction at a right angle to the sheet conveying direction. The region D1 in the horizontal direction has the same length as the sheet feed roller 60.

The region D1 may become narrower to a line shape. Depending on accuracy of each part or component, the sheet S may contact the separation pad 64 at an end part or one or more points of a middle part of the region D1 in a form of spots. As described above, the image forming apparatus employing the separation pad feeding system has the sheet separation nip region N of a substantially narrow and unstable shape.

Accordingly, the separation pad 64 holds the sheet S substantially unstably with insufficient sheet retention. Consequently, stick-slip vibrations can occur easily. Once the stick-slip vibration occurs, the vibration generates abnormal sound and the noise can increase easily.

In order to eliminate the unstable state of the region D1 of the sheet separation nip region N, the sheet S is supported from below by the lower face of both of the projections 66. As the sheet S is raised by the projections 66 disposed at both ends of the receiver 63, the sheet S is pressed against the sheet feed roller 60 on a straight line E connecting the projections 66, as illustrated in FIG. 12A.

Accordingly, by holding the sheet S at multiple points, the region of the sheet separation nip region N is substantially expand, as illustrated by a region D2 having a trapezoidal shape in FIG. 12A. As a result, the sheet S contacts the outer circumferential surface 60*a* of the sheet feed roller 60 at the region D2 in a manner of surface contact.

By substantially expanding the sheet separation nip region N, a contact area and state of the sheet S to the separation pad 64 becomes stable. Consequently, the sheet retention of the sheet S by the separation pad 64 can be enhanced, and therefore unwanted squeal of sheet can be prevented. The region D2 having a trapezoidal shape is elevated from the separation pad 64 and extends along the outer circumferential surface 60*a* of the sheet feed roller 60, which forms a three-dimensional shape. This shape of the region D2 functions as a cushion that can softly reduce and absorb vibration causing the abnormal sound of the sheet S in the sheet separation nip region N.

Further, in order to stabilize the region D2 of the sheet separation nip region N, it is more effective to dispose the projections 66 as close as the sheet separation nip region N in the sheet conveying direction. However, as the projections 66 are disposed closer to the sheet separation nip region N in the sheet conveying direction, a gap between the outer circumferential surface 60*a* of the sheet feed roller 60 and the surface 64*a* of the separation pad 64 becomes narrower. Due to this reason, if the projections 66 are extended to a closer position to the sheet separation nip region N, the projections 66 eat and cut in to the outer circumferential surface 60*a* of the sheet feed roller 60.

In this case, similar to the above-described examples, as the receiver 63 is pressed down, the sheet separating pressure can be decreased easily. Further, since the sheet S and the surface 64*a* of the separation pad 64 hardly contact at an upstream part from the sheet separation nip region N, an effect to separate the sheets S in the bundle of sheets is reduced, which can cause multifeed easily.

The configuration of the sheet feeder 600 according to this example can eliminate these inconvenience, prevent abnormal noise while securing a sufficient margin to avoid multifeed, and prevent the leading end fold and misfeed caused by the projections 66.

As previously described, FIG. 12B is an enlarged cross sectional view illustrating the sheet feed and separation area of the sheet feeder 600 according to this example and FIG. 12C is an enlarged view illustrating the receiver 63. In this example, the sheet feeder 600 includes the second projection 67 disposed downstream from the first projections 66 in the sheet conveying direction. The second projection 67 includes a top face 67*d* disposed projecting relatively upwardly from the outer circumferential surface 60*a* of the sheet feed roller 60.

A guide surface is formed between the top face 66*a* of each of the first projections 66 and the top face 67*d* of the second projection 67 to function as a rounded face 67*e* having a recess or a curve projecting outwardly from the sheet feed roller 60 to the separation pad 64, that is, a recessed part recessed inwardly to the sheet feed roller 60. The rounded face 67*e* as a guide surface gradually reduce the angle of the sheet S conveyed from the first inclined surface 66*c* to a third inclined surface 67*b* when the sheet S enters the sheet separation nip region N. Accordingly, the sheet S can be conveyed to the third inclined surface 67*b* smoothly, which can contribute to prevention of misfeed of sheets due to a reduction in sheet conveyance load.

As described above, the top face 67*d* alone of the second projection 67 in the vicinity of the sheet separation nip region N is arranged to bite the outer circumferential surface 60*a* of the sheet feed roller 60 and a top face 66*d* of each of the first projections 66 is disposed lower than the outer circumferential surface 60*a* of the sheet feed roller 60. By so doing, a top face shape of the first projections 66 and the second projection 67 can be formed so that a force to press down the receiver 63 can be reduced.

Further, by causing the second projection 67 to hold the sheet S, the sheet separation nip region N can be stabilized and abnormal noise caused by stick-slip vibration can be reduced. In addition, by increasing the number of projections as the first projections 66 and the second projection 67, the height of the second projection 67 alone is increased to prevent a force to be applied in a direction to press down the receiver 63, which can prevent occurrence of multifeed of sheets.

In a case in which the sheet feeder 600 according to this example includes the receiver 63 having the rotary shaft 63*b* disposed downstream in the sheet feeding direction, a moment that acts to press down the receiver 63 due to abutment of the sheet S becomes smaller as a load receiving point is located closer to the rotary shaft 63*b* of the receiver 63. Therefore, a reduced amount of the sheet separating pressure applied by a force in which the second projection 67 disposed close to the rotary shaft 63*b* receives from the sheet S is smaller than a reduced amount thereof related to the first projections 66. Consequently, even though the sheet separating pressure of the second projection 67 is reduced, the reduced amount thereof has a smaller adverse effect to multifeed.

Accordingly, as illustrated in FIGS. 12B and 12C, the second projection 67 is disposed relatively downstream from an intermediate position or a half position between the sheet separation nip region N and the upstream end 64*b* of the separation pad 64 and the top face 67*d* of the second projection 67 is extended to a height where the top face 67*d* thereof rather bites into the outer circumferential surface 60*a* of the sheet feed roller 60.

In order to optimize the position and height of the second projection 67, it is preferable that multiple sheet feeders are prepared to check respective states of generation of vibration and noise (abnormal sound) of the receiver 63 in sheet feeding before determining the position and height of the second projection 67 that generate a smallest amount of vibration and noise (abnormal sound).

The graph of FIG. 13 shows results of test conducted using the sheet feeder 600 with the second projection 67 according to this example and the comparative sheet feeder without the second projection 67 on comparison of respective vibration accelerations obtained by feeding sheets using these sheet feeders. The sheet feeder 600 and the comparative sheet feeder are basically identical in configuration and materials, except whether or not the second projection 67 is provided thereto.

The following units and materials were used in the tests:

Material of Separation Pad 64: Urethane foam rubber;

Material of Receiver 63: Polycarbonate (PC);

Material of Sheet Feed Roller 60: EPDM;

Diameter of Sheet Feed Roller 60: φ36 mm;

Sheet Conveying Speed of Sheet Feed Roller 60: 60 mm/s;

Width of Sheet Separation Nip Region N (Width of Sheet Feed Roller 60): 50 mm;

Sheet Separation Nip Pressure: 3N;

Type of Sheet: Plain Paper (Askul Multi-Paper Super White A4);

Angle of Entrance of Sheet: 30 degrees;

Measuring Instrument: Acceleration Pickups (Manufacturer: PCB, Model: 352C22); and FFT Analyzer (Name: Multi Data Station, Manufacturer: Ono Sokki Co., Ltd., Model: DS-2100).

The waveforms shown in FIG. 13 were results of frequency analysis performed by FFT (Fast Fourier Transform) on vibration generated on the receiver 63 when the sheet S is fed by the sheet feed roller 60 of the sheet feeder 600 according to this example and by the sheet feed roller 60 of the comparative sheet feeder. In the graph of FIG. 13, a horizontal axis indicates frequency [Hz] and a vertical axis indicates acceleration [G]. The waveform indicated by a dotted line is the result obtained by tests with the sheet feeder 600 and the waveform indicated by a solid line is the result obtained by tests with the comparative sheet feeder that does not include the second projection 67.

According to the graph of FIG. 13, as the value of acceleration [G] increases, greater level of abnormal sound occurs. The abnormal sound is caused by the stick-slip vibration of the sheet S to the separation pad 64.

It is to be noted that the maximum level of acceleration in the graph of FIG. 13 is 0.5 G and the maximum level of frequency is 2000 Hz.

In the results of the tests, the maximum acceleration value of the sheet feeder 600 according to this example was 0.06 G in the frequency range of from 0 Hz to 2000 Hz and the maximum acceleration value of the comparative sheet feeder was 4.71 G in the frequency range of from 0 Hz to 2000 Hz.

The test results have confirmed that the comparative sheet feeder generates a vibration level about 77 times as the vibration level of the sheet feeder 600 according to the example of this disclosure.

In the graph of FIG. 13, the vertical axis shows up to 0.5 G at maximum and parts of the waveform above 0.5 G (of the comparative sheet feeder) are omitted.

According to the test results, compared to the comparative sheet feeder, the sheet feeder 600 according to this example having the second projection 67 can significantly reduce vibration generating on the receiver 63. Accordingly, it was proved that the second projection 67 provided to the sheet feeder 600 is effective to restrain stick-slip vibration that is generated due to wear between the separation pad 64 and the sheet S.

It was also proved that, restraint of stick-slip vibration can stabilize movement and accuracy of sheet conveyance and reduce or prevent occurrence of abnormal sound due to the restraint of stick-slip vibration.

Next, a description is given of a detailed configuration of the receiver 63 having the first projections 66 and the second projection 67 with reference to FIGS. 12B and 12C.

In this example, the receiver 63 is integrally formed with the first projections 66 and the second projection 67.

By forming the first projections 66 and the second projection 67 integrally with the receiver 63, the number of parts are reduced, and therefore a tooling cost can be reduced.

The second projection 67 includes the third inclined surface 67*b*, a fourth inclined surface 67*c*, and the top face 67*d*. The third inclined surface 67*b* is disposed upstream in the sheet conveying direction. The fourth inclined surface 67*c* is disposed downstream in the sheet conveying direction. The top face 67*d* of the second projection 67 connects the third inclined surface 67*b* and the fourth inclined surface 67*c*.

It is preferable that an angle θ4 of the fourth inclined surface 67*c* relative to the surface 64*a* of the separation pad 64 is set to be 90 degrees or smaller. It is more preferable that the angle θ4 is set to be 45 degrees or smaller. Accordingly, when the sheet S leaves from the fourth inclined surface 67*c*, the trailing end of the sheet S is restrained from unstable motion thereof. Consequently, the sheet S can be prevented from colliding with the surface 64*a* of the separation pad 64 and, as a result, a reduction in noise (sound) can be enhanced.

As illustrated in FIGS. 12B and 12C, the first projections 66 and the second projection 67 are continuously arranged on the same straight line in the sheet conveying direction. According to this configuration, the sheet S can be forwarded from the first inclined surface 66*c* to the third inclined surface 67*b* smoothly. Therefore, the sheet conveyance load applied when the sheet S moves to the third inclined surface 67*b* is reduced, and molding of the receiver 63 becomes simpler.

Further, it is preferable that an angle θ3 of the first inclined surface 66*c* relative to the third inclined surface 67*b* is set to be 45 degrees or smaller. It is more preferable that the angle θ3 is set to be 30 degrees or smaller. Accordingly, when the sheet S enters the sheet separation nip region, the angle of the sheet S and the first inclined surface 66*c* becomes more acute (i.e., the leading end of the sheet S moves more parallel to the surface 64*a* of the separation pad 64). Consequently, the misfeed due to excess of the sheet conveyance load on the sheet S can be prevented.

Further, an intersection point connecting the first inclined surface 66*c* and the third inclined surface 67*b* is the rounded face 67*e* that is curved inwardly to the sheet feed roller 60 as illustrated in FIG. 12C. Accordingly, when the sheet S enters the sheet separation nip region, the angle of the sheet S and the first inclined surface 66*c* gradually becomes more acute (i.e., the leading end of the sheet S moves more parallel to the surface 64*a* of the separation pad 64). Consequently, the misfeed due to a reduction in the sheet conveyance load on the sheet S can be prevented.

Further, as illustrated in FIG. 12C, the rounded face 67*e* is located higher than the surface 64*a* of the separation pad 64. Consequently, the sheet S can enter the sheet separation nip region to the surface 64*a* of the separation pad 64 smoothly and, as a result, the leading end fold and misfeed of the sheet S can be prevented.

Different from FIG. 12C, the rounded face 67*e* can be located lower than the surface 64*a* of the separation pad 64 (on the side of the receiver 63). By so doing, the angle of entrance of the sheet S to the surface 64*a* of the separation pad 64 can be greater, so that the surface 64*a* of the separation pad 64 and the sheet S can contact easily. Consequently, sheet separation performance can be enhanced.

Figure 14:
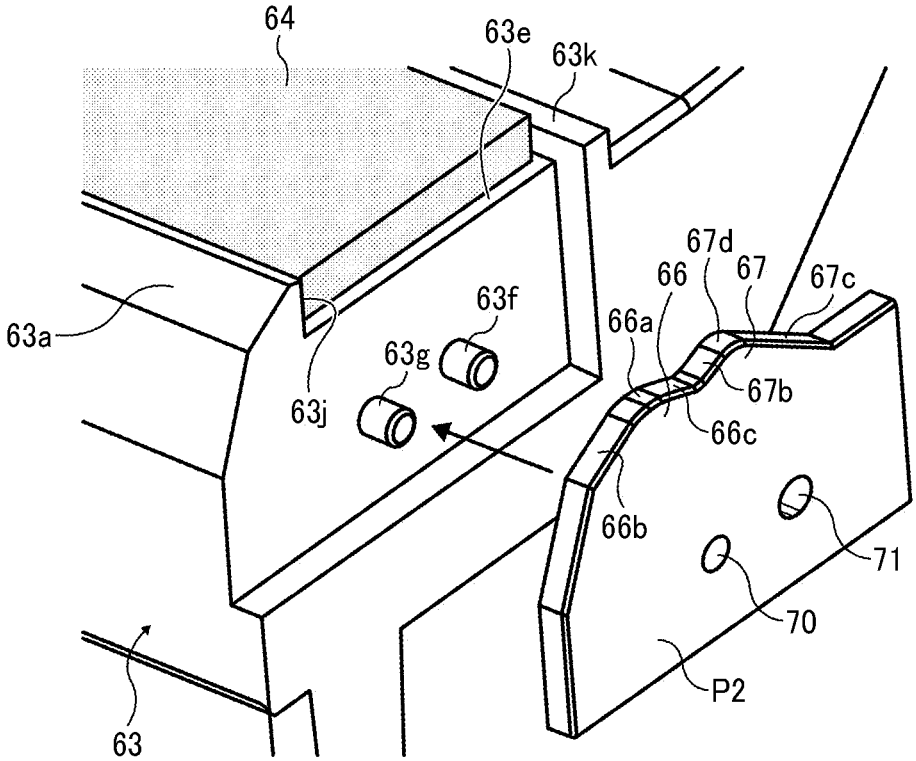
FIG. 14 is a perspective view illustrating an assembly of a receiver according to yet another example of this disclosure.

Next, a description is given of the sheet feeder 600 of the image forming apparatus 100 according to another example of this disclosure with reference to FIG. 14.

In this example, the top faces of the first projections 66 and the second projection 67 are identical to those of the previous example. The configuration of the projections 66 of the sheet feeder 600 according to this example is basically identical to the configuration of the projections 66 of the sheet feeder 600 according to the previous example. Except, the sheet feeder 600 according to this example includes a guide plate P2 having the first projections 66 and the second projection 67 and is provided to the sheet feeder 600 separately from the receiver 63. The guide plate P2 functions as an attachment to the receiver 63. Further, the guide plate P2 is different from the guide plate P1 in which the second projection 67 is additionally disposed to the guide plate P2.

By detachably attaching the guide plate P2 to the receiver 63, the guide plate P2 that is formed by a material different from the guide plate P1 can be selectively changed from the guide plate P1 depending on paper properties or replaced from a worn-out guide plate P2.

Further, similar to the previous example, multiple combinations of the round opening 70 and the lateral elliptical opening 71 are formed on a side surface of the guide plate P2. By so doing, the position of the guide plate P2 can be easily adjusted, accordingly.

Figure 15A:
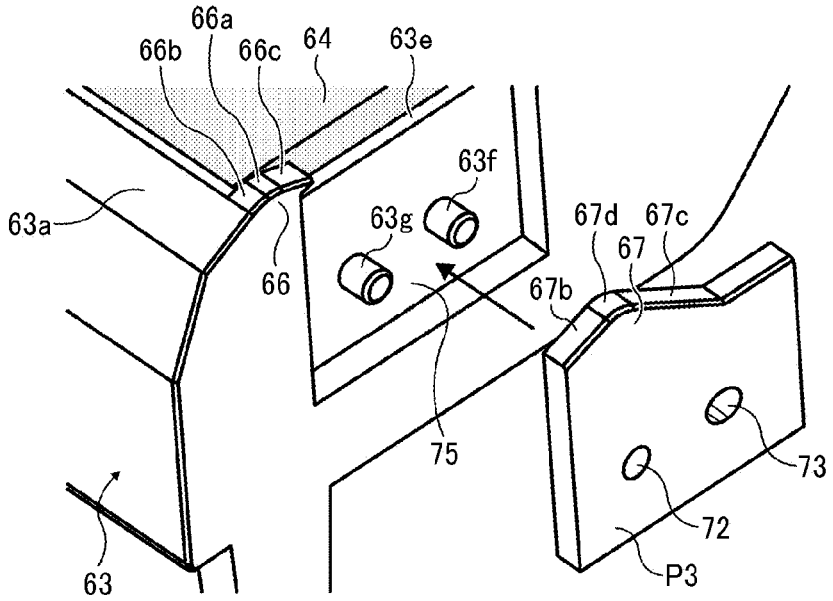
FIGS. 15A and 15B are perspective views illustrating an assembly of a receiver according to yet another example of this disclosure.
Figure 15B:
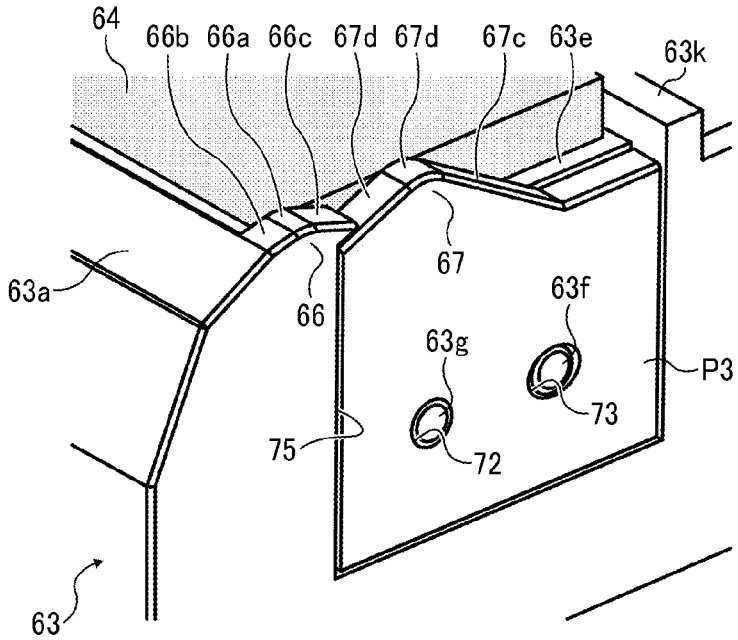
Figure 16:
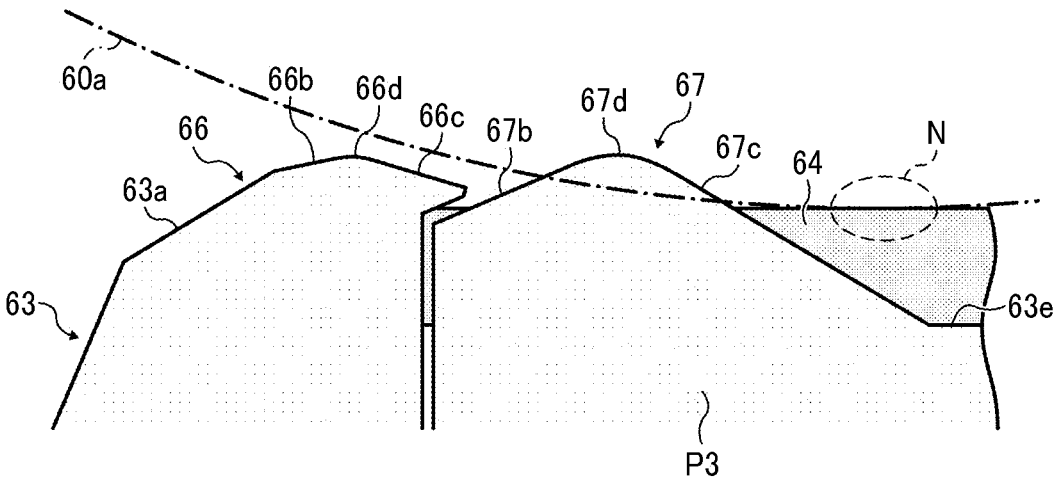
FIG. 16 is an enlarged side view illustrating the receiver of the sheet feeder of FIGS. 15A and 15B.

Next, a description is given of the sheet feeder 600 of the image forming apparatus 100 according to another example of this disclosure with reference to FIGS. 15A, 15B, and 16.

In this example, the first projections 66 are integrally disposed with the receiver 63 and a guide plate P3 that includes the second projection 67 is provided to the sheet feeder 600 separately from the receiver 63 and the first projections 66. The guide plate P3 functions as an attachment to the receiver 63.

In this example, the configuration for positioning the second projection 67 is identical to the configuration according to the previous example. Specifically, the position of the guide plate P3 and the position of the second projection 67 are determined by engaging a round opening 72 and a lateral elliptical opening 73 formed on the side surface of the second projection 67 with the short engaging shafts 63*f* and 63*g*, respectively, formed on a side cutout 75 of the receiver 63.

Similar to the previous examples, the first projections 66 and the second projection 67 are continuously arranged on the same straight line in the sheet conveying direction. In order to dispose the first projections 66 and the second projection 67 as described above, the side cutout 75 to accept the guide plate P3 is cut to a given depth.

In this example, the second projection 67 projects upper than the outer circumferential surface 60*a* of the sheet feed roller 60. Therefore, the second projection 67 receives a greater sheet conveyance load that is applied from the sheet S than the first projections 66, and can wear easily. According to the configuration according to this example, the guide plate P3 that includes the second projection 67 can replace with a resin plate or a metal plate both of which are less wearable and have a relatively low coefficient of friction. In addition, the guide plate P3 alone having the worn second projection 67.

Further, similar to the previous examples, multiple sets of combinations of the round opening 72 and the lateral elliptical opening 73 are formed on the side surface of the second projection 67. By so doing, the position of the guide plate P3 having the second projection 67 and the position of the second projection 67 can be easily adjusted, accordingly.

Further, in order to prevent inconvenience such as misfeed caused when the leading end of the sheet S is caught by a step generated between the first inclined surface 66*c* of the first projections 66 and the third inclined surface 67*b* of the second projection 67, a downstream end of the first inclined surface 66*c* and the upstream end of the third inclined surface 67*b* are arranged so as to be overlaid in the vertical direction, as illustrated in FIG. 16.

As described above, the downstream end of the first inclined surface 66*c* is disposed at a position higher than the upstream end of the third inclined surface 67*b*. Therefore, the step formed between the first inclined surface 66*c* and the third inclined surface 67*b* can cover the step and prevents misfeed.

Alternative to this configuration of the present example, the second projection 67 may integrally be formed with the receiver 63 and a different guide plate having the first projections 66 thereon may be provided to the sheet feeder 600 separately from the receiver 63 and the second projection 67. According to this configuration, the position and material of the first projections 66 formed on the guide plate can be adjusted depending on paper properties.

Figure 17A:
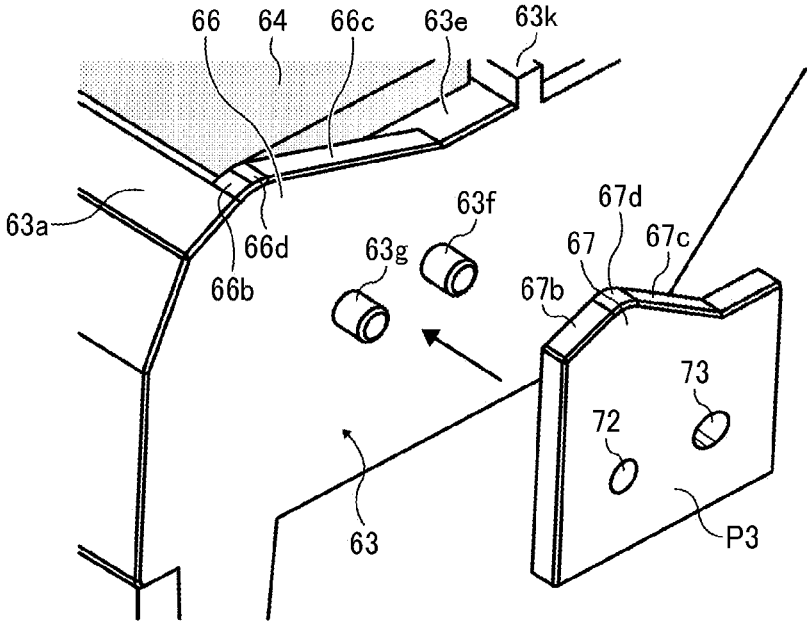
FIGS. 17A and 17B are perspective views illustrating an assembly of a receiver according to yet another example of this disclosure.
Figure 17B:
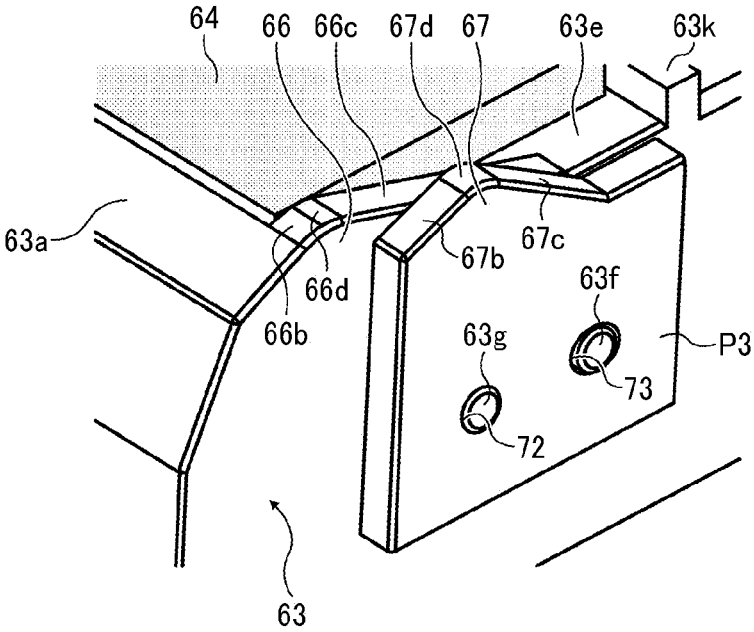

Next, a description is given of the sheet feeder 600 of the image forming apparatus 100 according to another example of this disclosure with reference to FIGS. 17A and 17B.

In this example, the first projections 66 and the second projection 67 are arranged on different straight lines in the sheet conveying direction. Similar to the previous example, the first projections 66 in this example are integrally disposed with the receiver 63 and the guide plate P3 that includes the second projection 67 is provided to the sheet feeder 600 separately from the receiver 63 and the first projections 66.

In this example, there is a region where the leading end of the sheet S separates from the guide surface, which are the first inclined surface 66*c* and the third inclined surface 67*b*. Therefore, in a case in which the sheet is conveyed with the leading end thereof curled downwardly, an angle of entrance of the leading end of the sheet S to the third inclined surface 67*b* increases, and therefore misfeed and leading end fold can occur easily.

Figure 18:
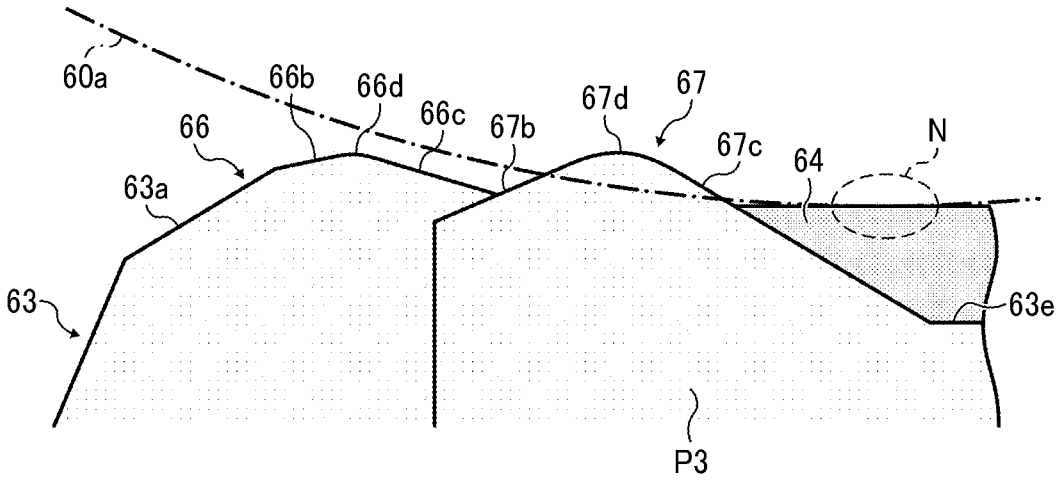
FIG. 18 is an enlarged side view illustrating the receiver of the sheet feeder of FIGS. 17A and 17B.

In order to address this inconvenience, the guide plate P3 having the second projection 67 according to this example is located outside the first projections 66 in the width direction. In addition, a downstream end of the first inclined surface 66*c* and an upstream end of the third inclined surface 67*b* are arranged to intersect when viewed from the side as illustrated in FIG. 18. By so doing, the region where the leading end of the sheet S separates from the first inclined surface 66*c* and the third inclined surface 67*b* functioning as the guide surfaces, and therefore the sheet S can be stable when the leading end of the sheet S enters toward the third inclined surface 67*b*.

Alternative to this configuration of the present example, the second projection 67 may integrally be formed with the receiver 63 and a different guide plate having the first projections 66 thereon may be provided to the sheet feeder 600 separately from the receiver 63 and the second projection 67. The guide plate having the first projections 66 is located outside the second projection 67 in the width direction. According to this configuration, the position and material of the first projections 66 formed on the guide plate can be adjusted depending on paper properties.

The above-described embodiments are illustrative and do not limit this disclosure. Thus, numerous additional modifications and variations are possible in light of the above teachings. For example, elements at least one of features of different illustrative and exemplary embodiments herein may be combined with each other at least one of substituted for each other within the scope of this disclosure and appended claims. Further, features of components of the embodiments, such as the number, the position, and the shape are not limited the embodiments and thus may be preferably set. It is therefore to be understood that within the scope of the appended claims, the disclosure of this disclosure may be practiced otherwise than as specifically described herein.

What is claimed is:

1. A sheet feeder comprising a rotary body configured to contact and feed a recording medium downstream along a sheet conveying path;

a friction body facing the rotary body with the sheet conveying path interposed therebetween, the friction body forming a separation nip region with the rotary body and including an upstream transverse edge in the conveyance path, a downstream transverse edge in the conveyance path and two opposing lateral edges connecting the upstream and downstream transverse edges;

a receiver directly supporting the friction body at a position of the friction body opposite to the separation nip region; and multiple projections for guiding the recording medium toward the separation nip region, each of the multiple projections including a first inclined surface that is upstream of the upstream transverse edge and a second inclined surface that is downstream of the upstream transverse edge, at least a portion of each of the multiple projections projecting from the receiver beyond the friction body toward the rotary body wherein a top portion of each of the multiple projections, above the friction body, originates upstream of an upstream end of the friction body in the sheet conveying direction.

2. The sheet feeder according to claim 1, wherein a top face of each of the multiple projections is above an upstream end of the friction body in the sheet conveying direction.

3. The sheet feeder according to claim 1, wherein the receiver has an upstream end in the sheet conveying direction and includes a leading end separator having an inclined surface to guide a leading end of the recording medium toward the separation nip region, wherein a top face of each of the pair of projections is higher than the leading end separator.

4. The sheet feeder according to claim 1, wherein a top face of each of the multiple projections is above an upstream end of the friction body in the sheet conveying direction, wherein the first inclined surface extends from the top face of each of the multiple projections to a downstream side in the sheet conveying direction, wherein an angle of the first inclined surface of each of the multiple projections and a surface of the friction body is 90 degrees or below.

5. The sheet feeder according to claim 1, wherein a top face of each of the multiple projections is above an upstream end of the friction body in the sheet conveying direction, wherein each of the multiple projections includes the first inclined surface extending from the top face of each of the multiple projections to a downstream side in the sheet conveying direction; and the second inclined surface extending from the top face of each of the multiple projections to an upstream side in the sheet conveying direction, wherein an angle of the first inclined surface and the second inclined surface of each of the multiple projections is 45 degrees or below.

6. The sheet feeder according to claim 5, wherein the first inclined surface and the second inclined surface are continuously arranged in the sheet conveying direction via the top face of each of the multiple projections, wherein an outline of the top face viewed in an axial direction of the rotary body is a projecting surface that is curved outwardly toward the rotary body.

7. The sheet feeder according to claim 5, wherein an outline of the second inclined surface viewed in an axial direction of the rotary body is a projecting surface that is curved outwardly toward the rotary body.

8. The sheet feeder according to claim 5, wherein at least one of the first inclined surface and the second inclined surface has a width becoming narrower gradually from an upstream side to a downstream side in the sheet conveying direction.

9. The sheet feeder according to claim 1, wherein each of the multiple projections includes the first inclined surface extending from a top face of each of the multiple projections to a downstream side in the sheet conveying direction; and the second inclined surface extending from the top face of each of the multiple projections to an upstream side in the sheet conveying direction, wherein an outline of the first inclined surface viewed in an axial direction of the rotary body is a recessed surface that is curved outwardly from the rotary body.

10. The sheet feeder according to claim 1, wherein an outline of each of the multiple projections viewed in the sheet conveying direction has a projecting rounded surface projecting toward the rotary body.

11. The sheet feeder according to claim 1, wherein the multiple projections are located outside from both ends of the friction body in a width direction perpendicular to the sheet conveying direction.

12. The sheet feeder according to claim 1, wherein the multiple projections are formed integrally with the receiver.

13. The sheet feeder according to claim 1, wherein at least one of the multiple projections is formed separately from the receiver.

14. The sheet feeder according to claim 1, further comprising multiple attachments to selectively attach at least one of the multiple projections formed separately from the receiver, wherein a position of the at least one of the multiple projections is adjusted by selecting one of the multiple attachments when the at least one of the multiple projections is attached to the receiver.

15. The sheet feeder according to claim 1, wherein the multiple projections include a first projection and a second projection separate from each other.

16. The sheet feeder according to claim 15, wherein the first projection has a top face and the second projection has a top face, wherein the top face of the first projection and the top face of the second projection are continuously arranged on a same straight line in the sheet conveying direction.

17. The sheet feeder according to claim 15, wherein the first projection has a top face, the first inclined surface extending from the top face thereof to a downstream side in the sheet conveying direction, and the second inclined surface extending from the top face thereof to an upstream side in the sheet conveying direction, wherein the second projection has a top face and a third inclined surface upstream from the top face thereof in the sheet conveying direction, wherein an angle of the first inclined surface and the third inclined surface is 45 degrees or below.

18. An image forming apparatus comprising the sheet feeder according to claim 1.

19. The sheet feeder according to claim 1, wherein the first inclined surface is at least partially above the portion of the receiver relatively closest to the rotary body and extends toward an outer circumferential surface of the rotary body and the second inclined surface is at least partially above and declines toward a surface of the friction body.

* * * * *